US005734953A

United States Patent [19]

Tatsumi

[11] Patent Number: 5,734,953

[45] Date of Patent: Mar. 31, 1998

[54] DETACHABLE TONER SUPPLY AND PROCESSING ASSEMBLY FOR AN IMAGE FORMING APPARATUS AND HAVING A SHUTTER MECHANISM FOR TONER FLOW CONTROL

[75] Inventor: Kenzo Tatsumi, Kanagawa-ken, Japan

[73] Assignee: Ricoh Company, Ltd., Tokyo, Japan

[21] Appl. No.: 600,572

[22] Filed: Feb. 13, 1996

[30] Foreign Application Priority Data

Feb. 17, 1995 [JP] Japan ..... 7-029207
Oct. 25, 1995 [JP] Japan ..... 7-277756

[51] Int. Cl.[6] ..... G03G 15/08

[52] U.S. Cl. ..... 399/262; 399/119

[58] Field of Search ..... 355/200, 210, 355/245, 260; 222/DIG. 1; 399/110, 111, 119, 222, 252, 258, 260, 262, 106

[56] References Cited

U.S. PATENT DOCUMENTS

| | | | |
|---|---|---|---|
| 4,937,628 | 6/1990 | Cipolla et al. | 355/260 |
| 5,101,871 | 4/1992 | Susumu | 355/260 X |
| 5,419,468 | 5/1995 | Taki | 222/DIG. 1 X |
| 5,452,066 | 9/1995 | Marotta et al. | 355/200 X |
| 5,475,478 | 12/1995 | Nishimura et al. | 399/119 |
| 5,517,285 | 5/1996 | Nomura et al. | 355/245 |

FOREIGN PATENT DOCUMENTS

| | | |
|---|---|---|
| 56-120555 | of 1981 | Japan . |
| 2-201380 | 8/1990 | Japan . |
| 2-226268 | 9/1990 | Japan . |

*Primary Examiner*—Sandra L. Brase
*Attorney, Agent, or Firm*—Lowe, Price, LeBlanc & Becker

[57] ABSTRACT

An image forming apparatus having independently detachable toner supply units and image processing units. The toner supply unit includes a toner supply port, a first shutter controlling a toner flow path of the toner supply port, and a first guide rib formed on the toner supply unit. The image processing unit includes a toner acceptance port, a second shutter controlling the toner flow path of the toner acceptance port, and a second guide rib formed on the image processing unit. The first and second guide ribs engage the second and first shutters when the toner supply unit and the image processing unit are both attached to the main body of the image forming apparatus. If either the toner supply unit or the image processing unit is removed from the main body, the guide ribs disengage the corresponding shutters, causing the shutters to close the toner flow paths. Reassembling the toner supply unit with the image processing unit engages the shutters to reopen the toner flow paths.

50 Claims, 15 Drawing Sheets

Figure 5A
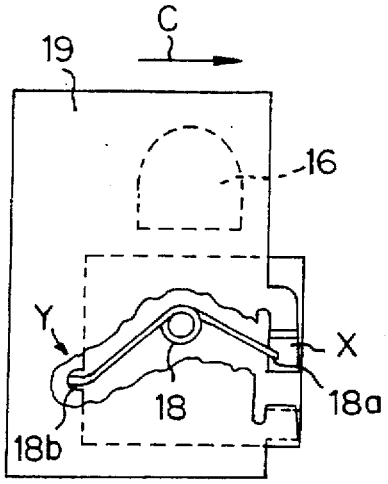
Figure 5B
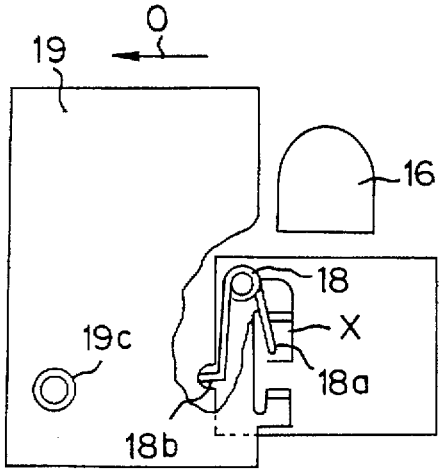
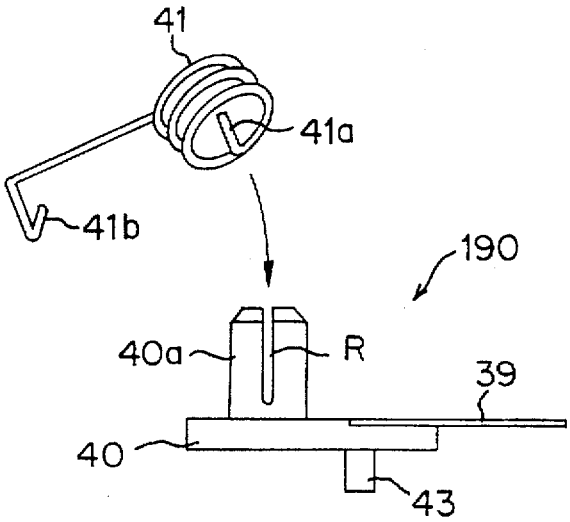
Figure 7

DETACHABLE TONER SUPPLY AND PROCESSING ASSEMBLY FOR AN IMAGE FORMING APPARATUS AND HAVING A SHUTTER MECHANISM FOR TONER FLOW CONTROL

TECHNICAL FIELD

The present invention relates to an image forming apparatus such as copying machines, printers, facsimile machines or the like. More specifically, the invention relates to image forming apparatus having detachable toner supply and image processing units.

BACKGROUND OF THE INVENTION

Electrophotographic image forming devices use a toner to form an image from an electrostatic latent image. The toner is deposited from an image developing device onto an electrostatic latent image formed on an image carrier, and the deposited toner is developed on a copied material such as paper to develop the image to be copied. The toner is accommodated in a toner supply device, and the toner supply device supplies the toner to an image developing device.

The toner supply device is typically detachable from the image developing device, and a shutter member is provided for opening and closing a toner supply port to prevent leakage of the toner.

For example, Japanese Unexamined Patent Application No. HEI 2-201380 and Japanese Unexamined Utility Model Application No. SHO 56-120555 disclose a technology for opening and closing a shutter member of the toner supply port for use with a fixing means of an image formation unit, whereby a detachable image developing device has an opening for accepting a developing agent.

Japanese Unexamined Patent Application No. HEI 2-226268 discloses a technology for operating a shutter member to open and close a toner supply port provided on one side of the toner supply side by using an electric clutch.

Japanese Unexamined Patent Application No. HEI 2-201380 describes a technology for opening and closing a shutter, whereby a toner supply part, fixed to an image forming unit, is separate from the detachment of an image developing device from the image forming unit. Thus, opening and closing of the shutter are relatively complicated. Further, the disclosed shutter member is not provided on the image forming unit. Consequently, when the image forming unit is removed from the image forming apparatus, toner is likely to be dispersed from the image forming unit outside of the image forming apparatus.

Japanese Unexamined Utility Model Application No. SHO 56-120555 discloses a developing agent supplying device having a toner supply port, and detachment from the image developing device has reduced complexity. However, due to the absence of a shutter member on the developing device for receiving the supply of developing agent from the developing agent supply device, the toner is likely to be dispersed from the image developing device outside of the apparatus when the image forming unit is removed from the image forming apparatus.

In Japanese Unexamined Patent Application No. HEI 2-226268, a shutter member for opening and closing the toner supply part is operated by using an electric clutch mechanism instead of a detachment of the developing device. Consequently, since electric parts such as solenoids or the like are used for constituting the clutch mechanism, the cost comes high.

DISCLOSURE OF THE INVENTION

There is a need for an image forming apparatus having a toner supply device and process cartridge each independently removable from the image forming apparatus, wherein a shutter mechanism selectably opens and closes a toner flow path between the toner supply device and the process cartridge when the toner supply device and the process cartridge are moved in relation to each other during assembly or disassembly from the image forming apparatus.

There is also a need for a toner supply assembly detachably mountable to an image forming apparatus having a processing assembly, the toner supply assembly having a toner supply port and a movable shutter that closes the toner supply port when the processing assembly and the toner supply assembly are moved in relation to each other.

There is also a need for an image forming apparatus having a toner supply and process cartridge, each independently removable from the image forming apparatus, wherein a first shutter mechanism selectably opens and closes a toner supply path from the toner supply and a second shutter mechanism selectably opens and closes a toner acceptance path to the process cartridge, the first and second shutters closing when the toner supply and the process cartridge are moved in relation to each other during assembly or disassembly from the image forming apparatus.

These and other needs are achieved by the present invention, wherein an image forming apparatus includes a toner supply assembly and a processing assembly each independently detachable from the image forming apparatus. A shutter is positioned to control a toner flow path between the toner supply assembly such that the shutter closes the toner flow path when the toner supply assembly and the processing assembly are separated.

In accordance with an aspect of the present invention, a shutter on the toner supply assembly controls a toner flow path between the toner supply assembly and the processing assembly in response to engagement with an engaging member on the processing assembly, wherein the shutter closes the toner flow path in response to disengagement of the shutter with the engaging member.

Hence, the shutter on the toner supply assembly is automatically closed when the toner supply assembly is detached from the processing assembly. Thus, the present invention not only prevents spillage of toner when the toner supply assembly and processing assembly are detached after removal from the image forming apparatus as a single unit, but also when either the toner supply or the processing assembly is individually removed from the image forming apparatus.

In accordance with another aspect of the present invention, a toner supply and processing assembly for an image forming apparatus includes a process cartridge for image development that is detachably mountable to a main frame of the image forming apparatus, a toner supply device for supplying toner to the process cartridge and detachably mountable to the main frame, and a shutter mechanism having a movable shutter member and a first engagement member for controlling a toner flow path between the toner supply device and the process cartridge. A second engagement member is positioned to contact the first engagement member such that the first shutter member moves to selectably open and close the toner flow path as the cartridge and toner supply device are moved in relation to each other during assembly or disassembly from the image forming apparatus.

Hence, the toner flow path is selectably opened and closed to provide automatic flow control during assembly to or disassembly from the image forming apparatus, minimizing complexity during assembly or disassembly.

Another aspect of the present invention provides a biasing device exerting a force on the shutter to close the toner control flow path upon disengagement with the engaging member that opens the shutter. Hence, the biasing device automatically causes the shutter to close the toner flow path when the toner supply assembly is separated from the processing assembly. Since the use of another engaging member to close the shutter would generate additional friction during the disassembly process, the biasing device minimizes the difficulty of the disassembly process.

In another aspect of the present invention, the toner supply device includes a toner supply port and a first shutter to control the toner supply port, and the process cartridge includes a toner acceptance port and a second shutter to control the toner acceptance port. Engaging members are positioned on the toner supply device and the process cartridge such that the toner supply port is closed before the toner acceptance port during disassembly of the toner supply device and the process cartridge. The positioning of the engaging members also causes the toner acceptance port to be opened before the toner supply port during assembly of the toner supply device and the process cartridge. In particular, the toner supply port is open only when the toner supply port is in substantial alignment with the toner acceptance port.

Hence, use of the first and second shutters and the positioning of the engaging members minimizes the loss of toner during disassembly, and ensures that no toner is spilled during assembly.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF DRAWINGS

FIGS. 5A and 5B are plane views showing closed and open states of the shutter member provided on the process cartridge of FIG. 2, respectively.

FIG. 7 is a side view showing a structure of the shutter member provided on the toner supplying apparatus of FIG. 6.

BEST MODES FOR CARRYING OUT THE INVENTION

The present invention provides an image forming apparatus that includes a toner supply assembly and a processing assembly each independently detachable from the image forming apparatus. A shutter is positioned to control a toner flow path between the toner supply assembly such that the shutter closes the toner flow path automatically when the toner supply assembly and the processing assembly are separated. A brief description of the image processing performed by the image forming apparatus will be provided, followed by a detailed description of the embodiments providing control of the toner control paths according to the present invention.

Figure 1:
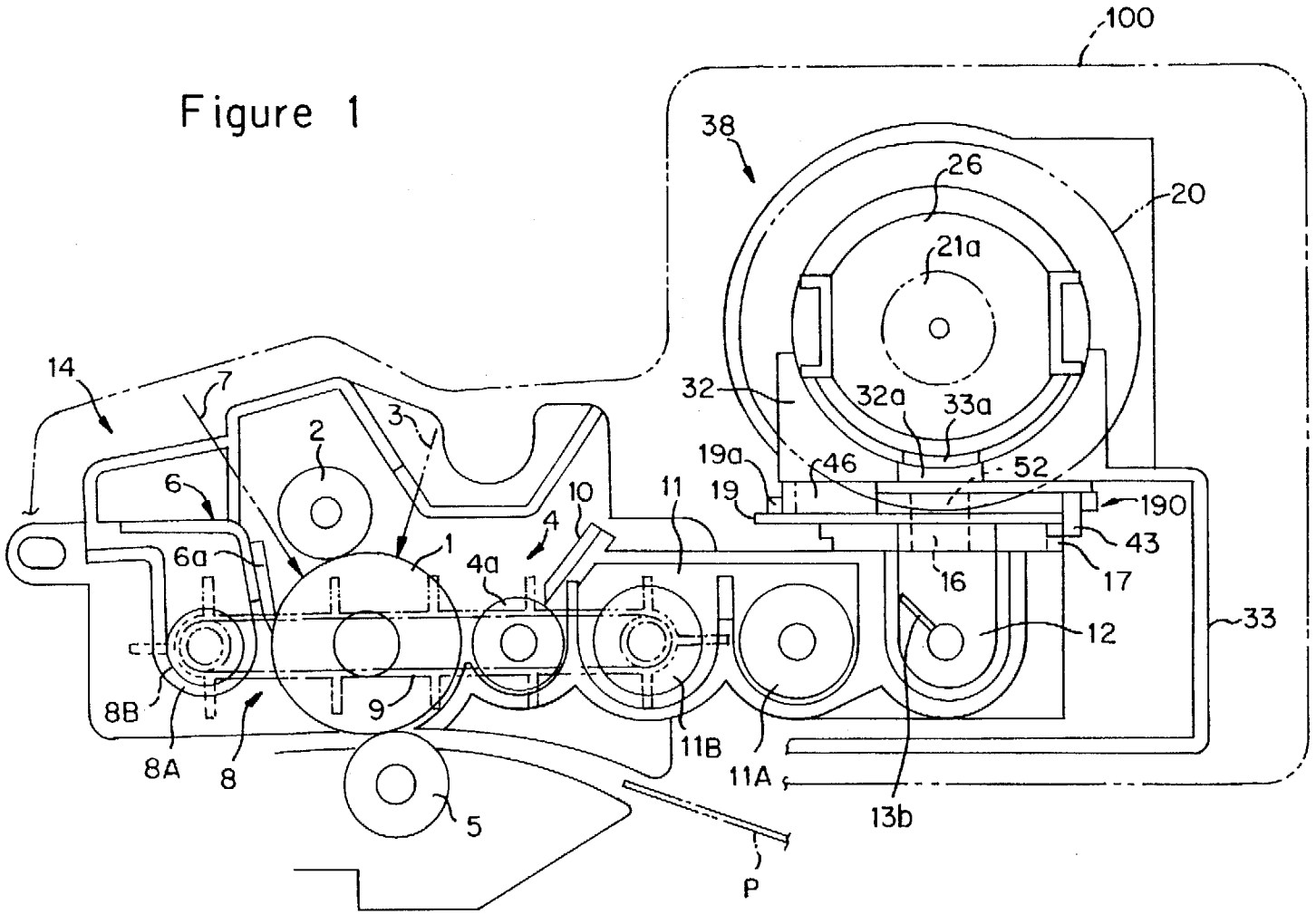
FIG. 1 is a view of an image forming apparatus according to a first embodiment of the present invention.

FIG. 1 is a diagram of an image forming system used in an image forming apparatus. The image forming apparatus includes a process cartridge 14 and a toner supply device 38, each detachably connected to a main body 100 of the image forming apparatus. The process cartridge 14 includes a drum-shaped photo-sensitive member 1 which is rotated by, for example, a driving motor. The process cartridge 14 also includes a charging roller 2 contacting the photosensitive member, an image developing device 4, a copying roller 5, and a cleaning device 6.

The surface of the photosensitive member 1 is discharged with discharging light from, for example, a quenching lamp so that the surface potential is averaged to a reference potential in a range from 0 to −150 V. A predetermined voltage or current is added to the charging roller 2, and the surface potential of the photosensitive member 1 is set to around −1100 V with the contact of the charging roller 2 with the surface of the photosensitive member 1. Exposure light 3 is illuminated from a known exposure optical system (not shown) onto the surface of the photosensitive member 1 between the charging roller 2 and the image developing device 4, with the result that an image forming part having a potential of about 0 to −290 V is formed on the illumination part.

The image developing device 4 has an image developing sleeve 4*a* having an applied charging bias of about −800 V to charge the toner. When the image part comes to the image developing sleeve 4*a*, the toner is electrostatically deposited onto the image part. A doctor plate 10 evenly distributes the toner inflow amount to the photosensitive member 1.

A copying paper P is conveyed from a paper feed part (not shown) and passed between the copying roller 5 and the photosensitive member 1. The copying paper P is positioned between the copying roller 5 and the photosensitive member 1, defined as the copying part, such that the end of the toner image on the photosensitive member 1 and the paper end are aligned. A copying bias is added to the copying roller 5 so that the toner image which is formed on the photosensitive member 1 is electrostatically absorbed by the copying paper P at the copying part. The toner image is copied onto the copying paper P, and the copying paper P is then conveyed to a fixing part having a heating roller and pad roller (not shown) to melt and fix the toner image onto the copying paper with heat and pressure. The copying paper having the copied object is then output from the copying machine.

The toner which remains on the surface of the photosensitive member 1 is then wiped off with a blade 6*a* provided on a cleaning device which slidably contacts the photosensitive member 1. The surface of the photosensitive member 1 charged with a residual potential is then discharged with a discharge light 7 from a quenching lamp (not shown) so that the image formation process of one image is completed. In addition, the toner which is wiped off with the blade 6*a* is conveyed to the toner conveyance part 8*a* with a toner conveyance coil 8*b* which constitutes a toner recycling means 8. The toner conveyed to the toner conveyance part 8A is conveyed to a developing agent stirring part 11 with a recycle belt for reuse.

Figure 2:
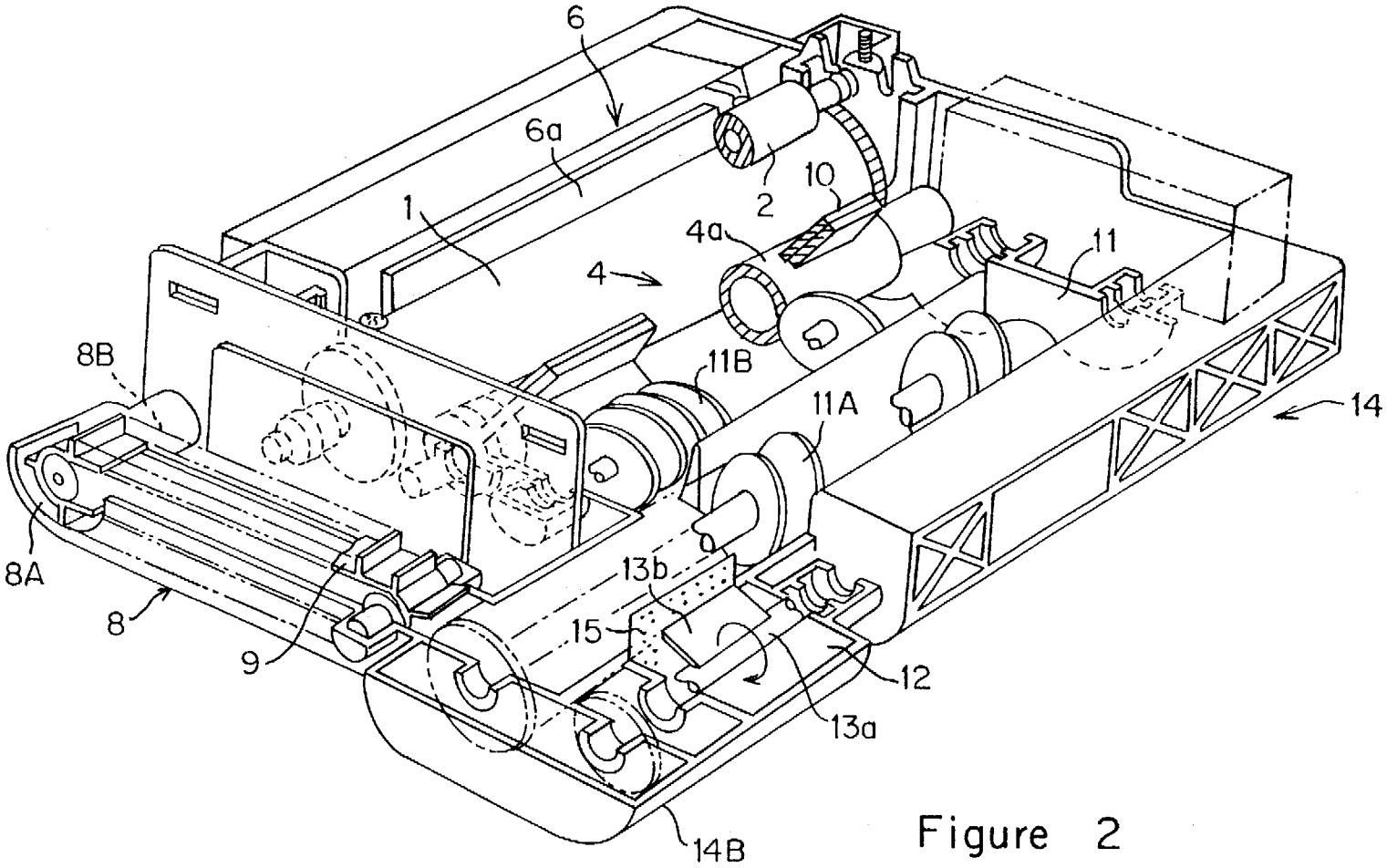
FIG. 2 is a perspective view showing an internal structure of the process cartridge of FIG. 1.
Figure 3:
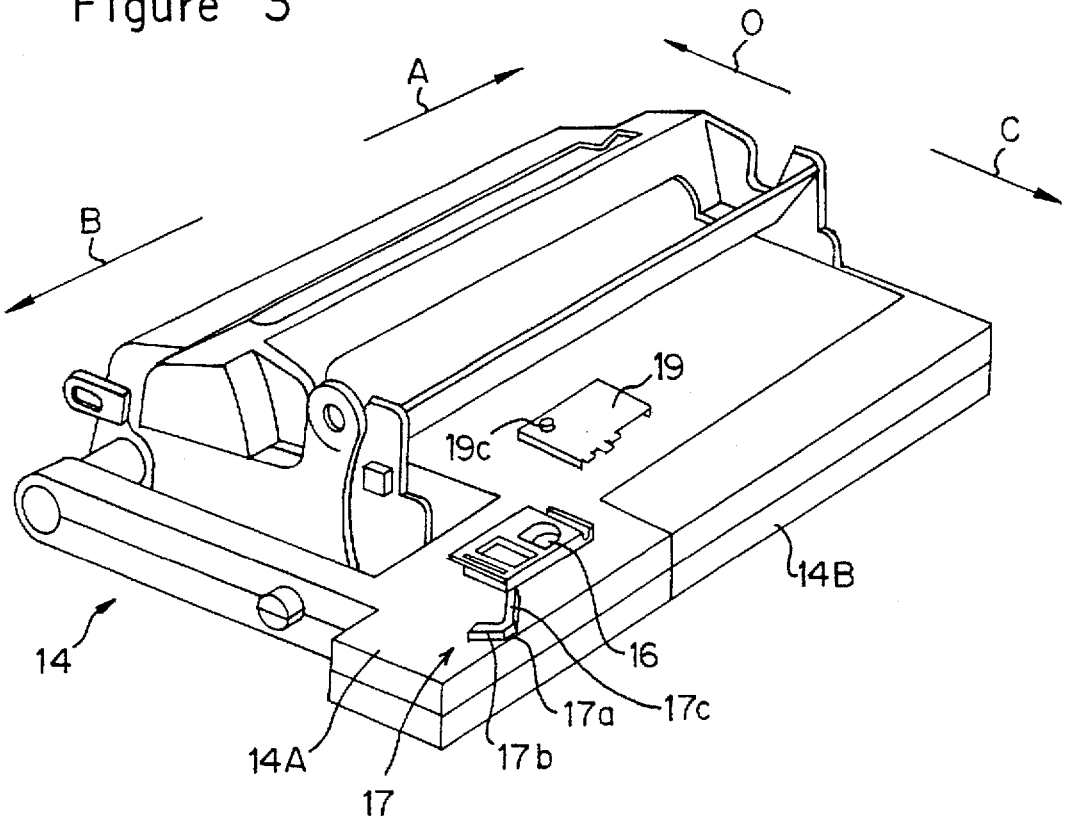
FIG. 3 is a perspective view showing an external view of the process cartridge of FIG. 2.
Figure 4:
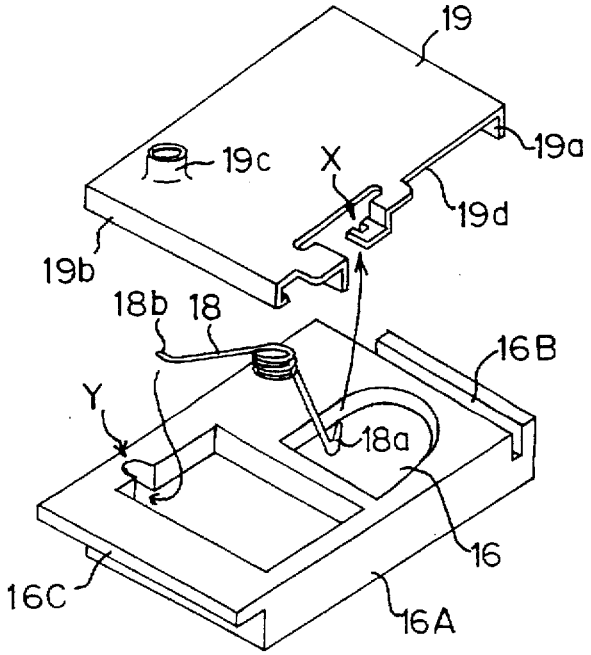
FIG. 4 is an exploded perspective view showing a structure of a shutter member provided on the process cartridge of FIG. 2.

FIGS. 2 and 3 are perspective views of the process cartridge according to a first embodiment of the present invention. The process cartridge 14 can be divided into an upper case 14A and a lower case 14B as shown in FIG. 3. The upper case 14A includes a toner acceptance port 16 which provides a toner flow path for toner to be supplied to the toner supplying part 12 formed in the lower case 14B. The toner acceptance port 16 is formed on the shutter support member 16A provided on the upper case 14A arranged above the toner supplying part 12*a*. A notch part Y is formed on the shutter support member 18A as shown in FIG. 4.

A shutter member 19 is provided on an upper part of the toner acceptance port 16 which is slidable in the direction which runs at a right angle with the detachment direction of the process cartridge with respect to the main body 100 (see FIG. 3), designated by arrows A and B. The shutter member 19 has a cross section which is configured into a square notch. The guide portions 19*a* and 19*b* are engaged with a guide groove 16B formed on the upper part of the shutter support member 16A and a lower end part 16C. On one side of the shutter member 19, a spring engagement part K is bent and formed. The shutter member 19 is biased with a coil spring 18 in a direction of closing the toner acceptance port 19 as shown in FIG. 5A. The spring 18 has ends 18*b* that engage with a notch part X formed on the shutter member 19. On an upper surface of the shutter member 19, a projecting part 19*c* is formed as shown in FIG. 4.

A first guide rib 17 is formed on an upper case 14A located before the toner acceptance port 16 (on the side of the direction of the arrow B) as shown in FIG. 3. The first guide rib 17 includes inclined surfaces 17*b* and 17*c* symmetrically positioned between a planar surface 17*a*, and is formed in a closing direction of the shutter member 19 designated by an arrow C in a trapezoidal configuration projecting toward the direction of closing the toner acceptance port 16.

The image developing sleeve 4*a* shown in FIGS. 1 and 2 has a fixed shaft in which five magnets are arranged. The outside surface of the developing sleeve 4*a* is covered with a non-magnetic pipe material. The developing agent moves on the image developing sleeve 4*a* with the rotation of the pipe material. The developing agent is a two component developing material comprising a small iron ball which is referred to as a carrier and a toner. The developing agent is circulated and stirred with the stirring screws 11A and 11B arranged in the developing agent stirring part 11 in the developing agent stirring part 11. The toner is charged with an electric load with stirring movement of the developing agent so that the toner is deposited onto the carrier and is conveyed to the developing sleeve 4*a*. Since the toner is deposited onto an electrostatic latent image on the photosensitive member 21, the toner is appropriately supplied from the toner supply device 38. In addition, a concentration sensor (not shown) for detecting toner concentration is arranged. This concentration sensor is constituted to emit a toner supply signal when the toner concentration becomes the reference concentration or less.

The toner supply part 12 provides uniform concentration of the toner supplied from the toner supply device 38. The toner supply part 12 provides a supply member 13*b* provided on the supply shaft 13*a* and a perforated member 15 in which a toner passage hole is formed so that the toner in the toner supplying part 12 is conveyed by small amounts from the toner supply passage of the perforated member 15 by rotating the supply member 13*b*.

Figure 6:
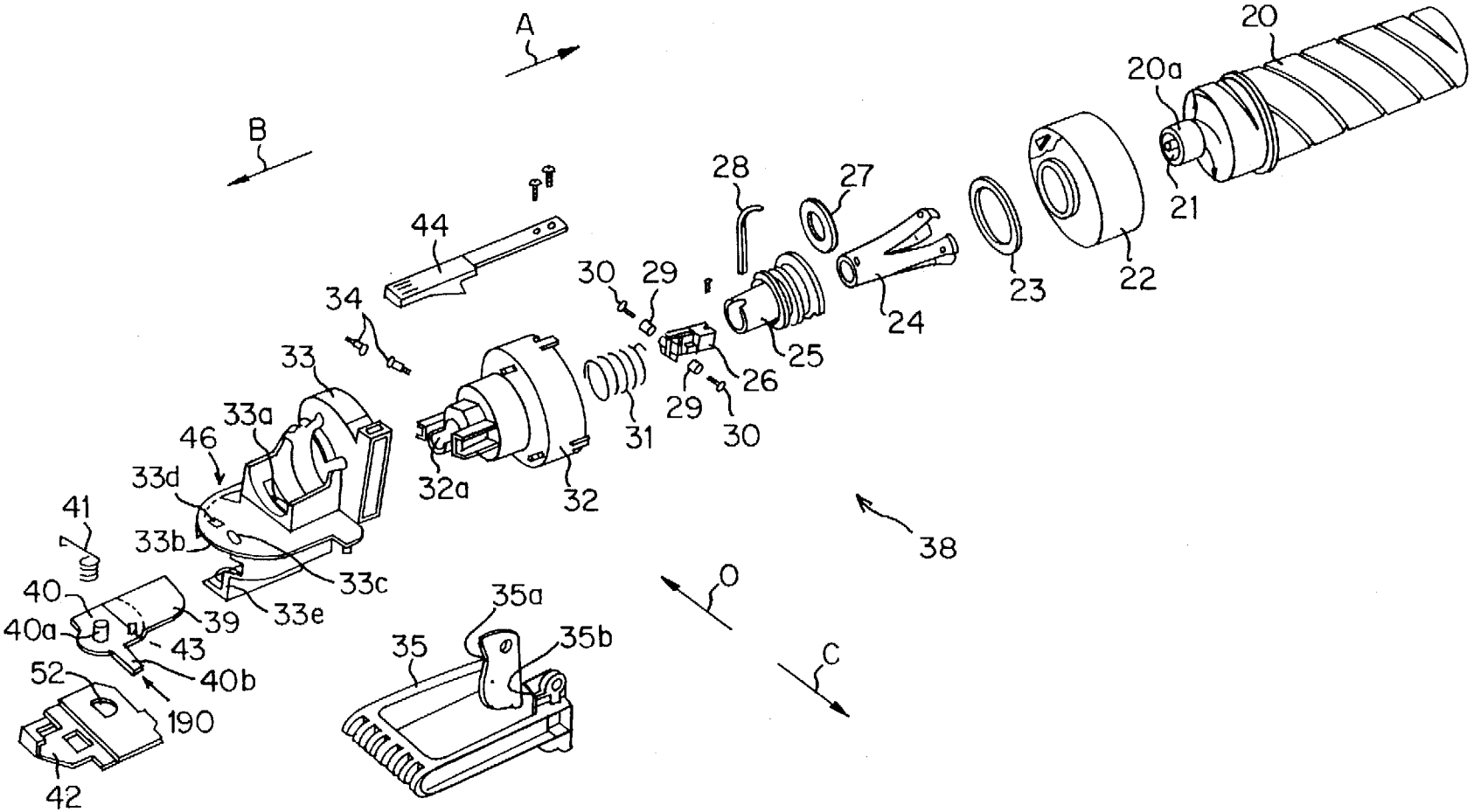
FIG. 6 is an exploded perspective view of a toner supplying apparatus according to the first embodiment.

FIG. 6 is an exploded view of the toner supply device 38 according to the first embodiment of the present invention. The toner supply device 38 primarily comprises a toner supply bottle 20 accommodating the supply toner, an inside case 32 in which the toner supply bottle 20 is assembled, an outside case 33, a shutter 190, and a toner supply port 52.

The toner bottle 20 is provided with a toner discharge port 20*a* which is sealed with a cap 21 on one end thereof. The toner bottle 20 is set to be slidable inside the inside case 32 together with the cylindrical bottle cover 22 which penetrates the toner discharge port 20*a*. The toner bottle 20 is rotated and driven by a bottle driving shaft (not shown). A zipper 24 is positioned between a bottle cover 22 and an inside case 32 for opening the cap 21 and is arranged together with the shaft 26 by penetrating the slider 25. A compression coil panel 31 is also provided for unsealing the cap 21. These members are assembled in the outside case 33. In the inside case a toner outflow port 32*a* is formed that supplies toner from the toner discharge port 20*a*. On the outside case 33, a toner drop port 33*a* supplies toner from the toner outflow port 32*a* and to a toner supply port 52. The toner supply port 52 thus provides a toner flow path from the toner supply device 38.

On the inside case 32 located on the right and left of the toner outflow port 32*a*, a cam lever 35 is assembled rotatably on a pin 34. A pair of rollers 29 are provided on the end of the shaft 26 and are engaged with cam parts 35A and 35B of the cam lever 35. The cam lever 35 is supported on the pin 30 with the result that the rotation operation of the cam lever 35 becomes smooth. The shape of the cam parts 35A and 35B is configured so that when the cam lever 35 is pressed down in a downward direction, the shaft 26 is moved against the compression spring 31 to open the cork 21 and then the shaft 26 is rotated toward the upward direction with the result that the shaft 26 is pressed by the compression spring 31 to close the cork 21.

Figure 8:
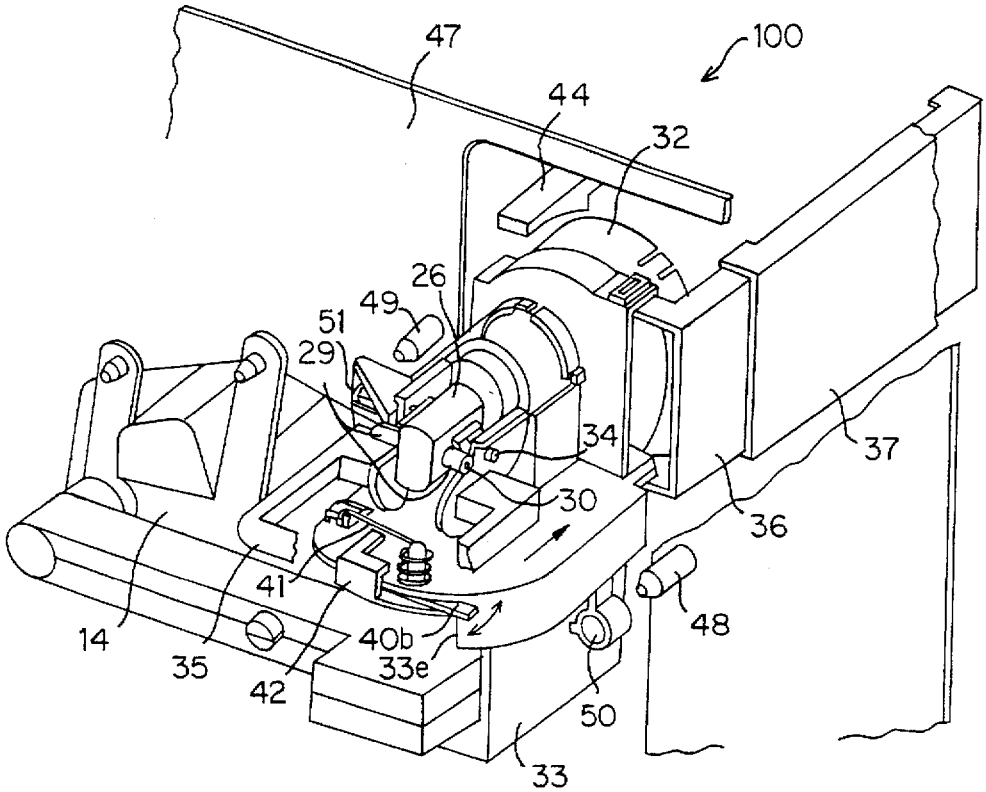
FIG. 8 is a partial exploded view showing an assembled state of the toner supplying apparatus and the process cartridge of the first embodiment.
Figure 10:
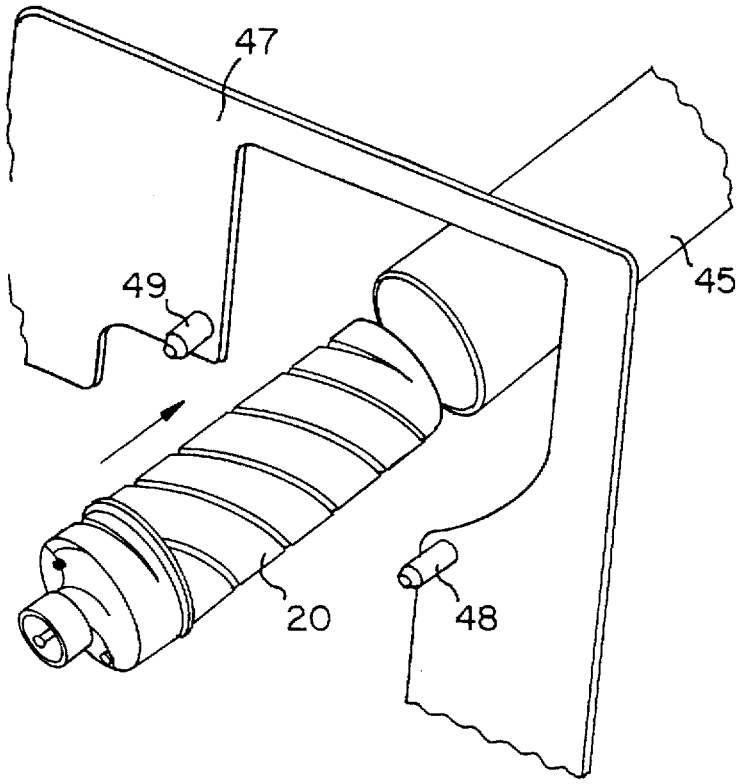
FIG. 10 is a perspective view of the toner bottle and bottle case of the toner supplying apparatus of FIG. 6.

A stopper 44 is screwed to the main body 100 of the toner supply device 38, and serves as a cork stopper. As shown in FIG. 10, a cylindrical bottle case 45 is arranged on the side of the main body 100. As shown in FIG. 8, an engagement part 53 and guide holes 50 and 51 are formed on the outside case 33. On the engagement part 53, the support member 36 slidably supported on the guide rail 37 fixed to the main body 100 is engaged while positioning pins 48 and 49 provided on a front plate 47 of the main body 100 are engaged with guide holes 50 and 51. The toner supply device 38 can be attached slidably at a predetermined position of the process cartridge 14 and the main body 100 with the engagement of the positioning pins 48 and 49 with guide holes 50 and 51. The predetermined position refers to a position where a first toner flow path defined by the toner supply port 52 and a second toner flow path defined by the toner acceptance port 16 on the side of the process cartridge 14 substantially align with each other.

FIG. 7 is a diagram of the shutter 190 of the toner supply device 38. The shutter 190 comprises a shutter support member 40 and a shutter member 39, and is arranged between the lower part 33*b* of the outside case 33 and the shutter press member 42 on which the toner supply port 52 is formed.

Figure 9:
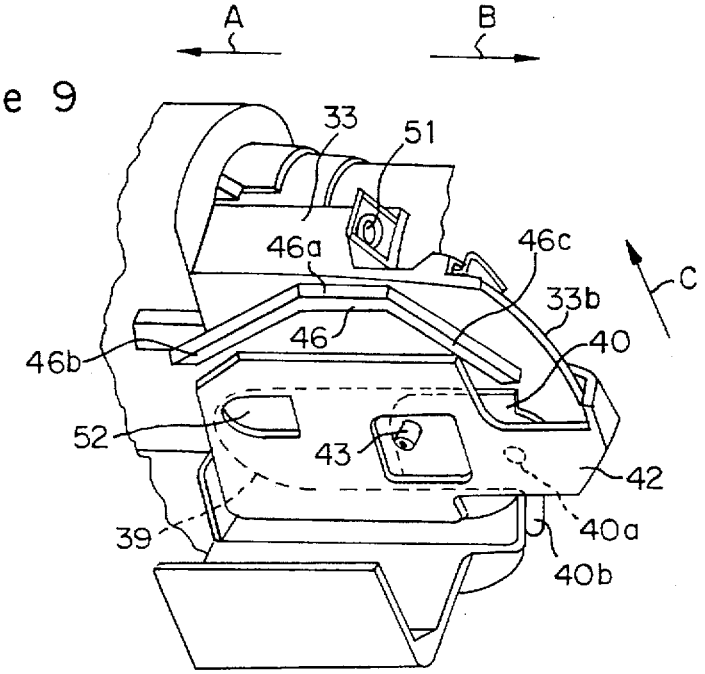
FIG. 9 is an exploded perspective view showing from a bottom view of the structure of the shutter member and the guide rib of the toner supplying apparatus of FIG. 6.

On the shutter support member 40, a sleeve 40*a* projecting upward is formed. The sleeve 40*a* is inserted into a hole 33*c* which is formed on the lower part 33*b* of the outside case 33. The sleeve 40*a* is rotatably supported on the case outside case 33. A slit R which extends in the lengthwise direction is provided on the sleeve 40*a*. On the sleeve 40*a*, a coil spring 41 is wound which has one end 41*a* engaged with the slit R and the other end 41*b* engaged with the spring engagement part 33*d* formed on the lower part 33*b* of the outside case. The coil spring 41 is rotated and biased in a direction of closing the toner supply port 52 with the shutter 190. The shutter 190 serves as a rotation stopper by contacting the lever 40*b* formed on the support 40 onto a notch 33*e* of the outside case 33 with this rotation energizing force. The shutter member 39 is extended and formed to the side of the toner supply port 52 from the sleeve 40*a* to sufficiently cover the toner supply port 52. On the bottom of the support part 40, a projecting member 43 is formed which extends in a downward direction from the toner sleeve 40*a* as shown in FIGS. 6 and 9. The projecting member 43 is arranged in a range in which the projecting part 17 can be engaged with the first guide rib 17 provided on the upper case 14A of the process cartridge 14.

FIG. 9 shows the formation of a second guide rib 46 on the lower part 33*b*. The second guide rib 46 guides the projecting part 19*c* of the shutter member 19 on the side of the process cartridge to open and close the shutter member. The second guide rib 46 has a planar surface 46*a* and inclined surfaces 46*b* and 46*c* symmetrically positioned about the planar surface 46*a*, and extending to form an acute angle with surface 96*a*, thereby forming a trapezoidal shape which projects toward the direction of an arrow D defining an opening direction of the shutter member 19. The second guide rib 46 has a substantially symmetric shape with respect to the detachment direction of devices designated by arrows A and B.

Relations between the first guide rib 17 and the projecting member 43 with the second guide rib 46 and the projecting member 19*c* will be described with reference to FIGS. 11A–11C and 12A–12C.

Figure 11C:
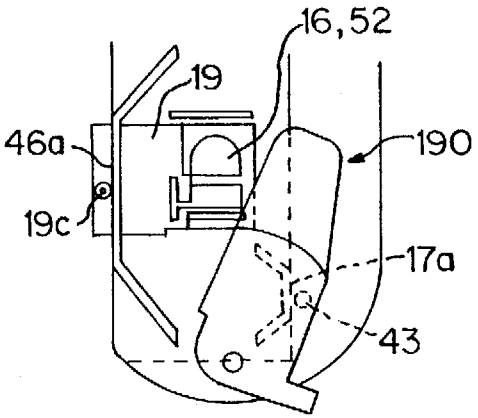
FIGS. 11A, 11B and 11C are diagrams illustrating one sequence of opening the shutters on the process cartridge and the toner supplying apparatus according to the first embodiment.
Figure 11B:
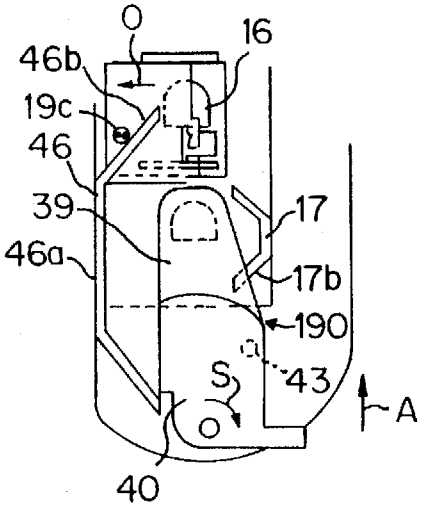
Figure 11A:
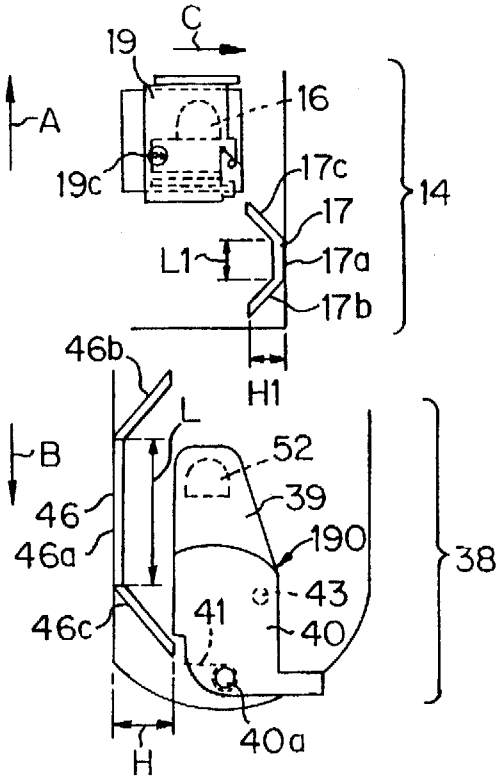

As shown in FIG. 11A, the overall length of the second guide rib 46 is longer than the overall length of the first guide rib 17 with respect to a detachment direction designated by arrows A and B. In addition, the length L of the planar surface 46*a* of the second guide rib 46 is longer than the length L1 of the planar surface 17*a* of the first guide rib 17. The projecting members 19*c* and 43 are positioned to engage with the respective inclined surfaces 17*b* (and 17*c*) and 46*b* (and 46*c*). The projecting member 19*c* is located opposite the first guide rib 17, and the projecting member 43 is located opposite the second guide rib 46. Surfaces 17*c* and 17*b* of guide rib 17 form an acute angle with surface 17*a*.

The overall length of the guide rib 46 ensures that the shutter member 19 begins opening before the shutter 190. Specifically, the projecting part 19*c* and the inclined surfaces 17*b* and 17*c* are positioned such that the projecting part 19*c* and the surfaces 46*b* and 46*c* are engaged before the engagement of the projecting part 43 with the inclined surfaces 17*b* and 17*c*. In addition, the ribs 17, 46 and projecting members 19*c*, 43 are positioned such that the shutter 190 opens faster than the shutter 19. The height H (elevation) of the incline surfaces of the second guide rib 46 and the height H1 (elevation) of the incline surfaces of the first guide rib 17 are set to a height which moves the shutter members 190 and 19 to an extent that the toner acceptance port 16 and the toner supply port 52 can be sufficiently opened.

The operation of the process cartridge 14 and the toner supply device 38 will be explained hereinbelow.

As shown in FIG. 11A, when the toner supply device 38 is disconnected from the process cartridge 14 attached on the main body 100 (not shown), the shutter member 19 closes the toner acceptance port 16 and the shutter member 39 closes the toner supply port 52. When the toner supply device 38 is connected to the process cartridge 14 by moving the toner supply device 38 in a direction designated by an arrow A, the inclined surface 46*b* of the second guide rib 46 contacts the projecting member 19*c* as shown in FIG. 11B so that the projecting member 19*c* is guided along the inclined surface 46*b* toward the planar surface 46*a*. Along with the movement of this projecting member 19*c*, the shutter member 19 which is biased in a direction of an arrow C with a spring 18 is moved in the opening direction designated by an arrow O as shown in FIGS. 5B and 11B. Further, when the toner supply device 38 is pushed into a direction of the arrow A, the projecting part 19 is relatively moved to reach the planar surface 46*a*. At this time, the shutter member 19 is completely opened as shown in FIG. 11C with the result that the toner acceptance port 16 provided on the side of the process cartridge 14 is opened.

In the meantime, when the projecting member 43 contacts the inclined surface 17*b* of the first guide rib 17 after the shutter member 19 is completely opened, the projecting member 43 is guided and displaced toward the planar surface 17*a* with the inclined surface 17*b* with the result that the shutter 190 is moved in an open direction designated by an arrow S centering on the axis 40*a*. Then when the projecting part 43 reaches the planar surface 17*a* as shown in FIG. 11C, the shutter 190 is completely opened and the toner supply port 52 provided on the side of the toner supply device 38 is opened so that the toner acceptance port 16 and the toner supply port 52 are aligned to form a toner flow path. In this state, the toner supply device 38 is attached filled with the toner. After the toner supply device 38 is completely attached, the leakage of the toner supply from the toner supply device 38 is prevented with the stopper 44 shown in FIG. 6. When the toner supply device 38 is removed (pulled out) from the process cartridge 14, the operation is carried out in an order reverse to the aforementioned operation.

Figure 12C:
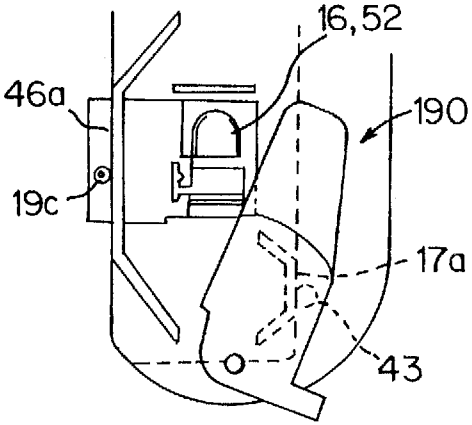
FIGS. 12A, 12B and 12C are diagrams illustrating another alternative sequence of opening the shutters on the process cartridge and the toner supplying apparatus according to the first embodiment.
Figure 12B:
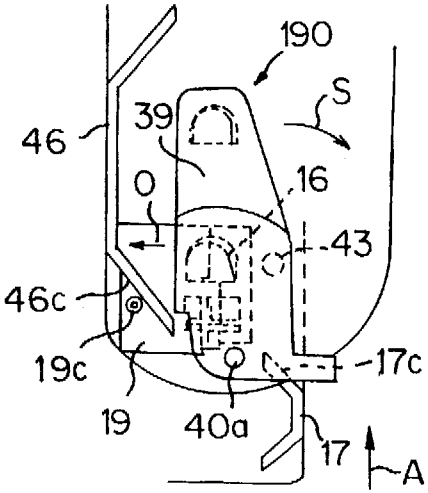
Figure 12A:
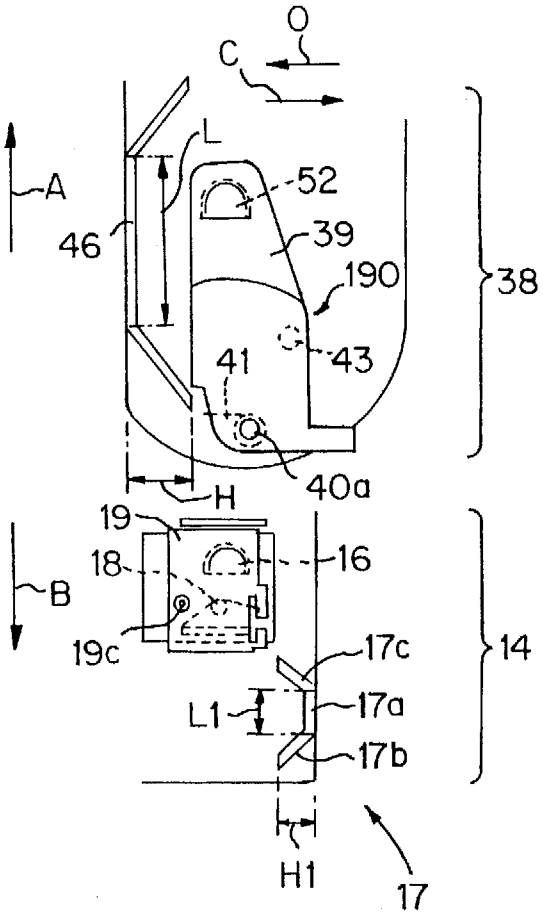

For example, as shown in FIG. 12A, if the process cartridge 14 is removed from the main body 100, the toner acceptance port 16 is sealed by the shutter member 19 that is biased by the spring 18 in a closing direction designated by an arrow C. When the process cartridge 14 is moved in an attachment direction designated by an arrow A, the projecting part 19*c* contacts the inclined surface 46*c* of the second guide rib 46 to be guided toward the planar surface 46*a*. Along with the movement of the projecting part 19*c*, the shutter member 19 which is biased in the direction of an arrow C, is moved in the opening direction designated by the arrow O. Further, when the process cartridge 14 is pushed in a direction of the arrow A, the projecting part 19*c* is relatively moved to reach the planar surface 46*a*. At this time, the shutter member 19 is completely opened as shown in FIG. 12C, and the toner acceptance port 16 provided on the side of the process cartridge 14 is opened.

In the meantime, when the inclined surface 17*c* of the first guide rib 17 contacts the projecting part 43, the shutter 190 is guided and displaced toward the planar surface 17*a* by the inclined surface 17*c* of the first guide rib 17 with the result that the shutter member 190 is completely opened. Thus, the toner supplying port 52 on the toner supply device 38 is opened and the toner acceptance port 16 on the process cartridge 14 are opened to form a toner flow path. In this state, the process cartridge 14 is filled with the toner.

When the process cartridge 14 is removed (pulled out) from the toner supply device 38 or the main body 100, the operation is carried out in a procedure reverse to the aforementioned operation, whereby the shutters move from the fully opened state of FIG. 12C to the partially open state of FIG. 12B, and then the closed state of FIG. 12A.

In this manner, the assembly including the toner supply device 38 and the process cartridge 14 in the first embodiment include shutters 19 and 190 that remain closed until both the toner supply device 38 and the process cartridge 14 are attached on the main body 100. In other words, when either of the toner supply device 38 or the process cartridge 14 is removed from the main body 100, the shutter members 19 and 190 are both closed with the result that the dispersion of the toner from the toner supply port 52 and the toner acceptance port 16 can be prevented.

Furthermore, in the detachment operation, since the shutter member 19 on the side of the process cartridge 14 is opened before the shutter member 19 on the side of the toner supply device 38, the toner supply port 52 is opened only after the toner acceptance port 16 has been opened. Hence, even if the toner is leaked at the time of the detachment operation, the leaked toner can be recovered because the toner acceptance port 16 is opened before than the toner supply port 52 thereby reducing the stains inside the image forming apparatus.

Figure 13B:
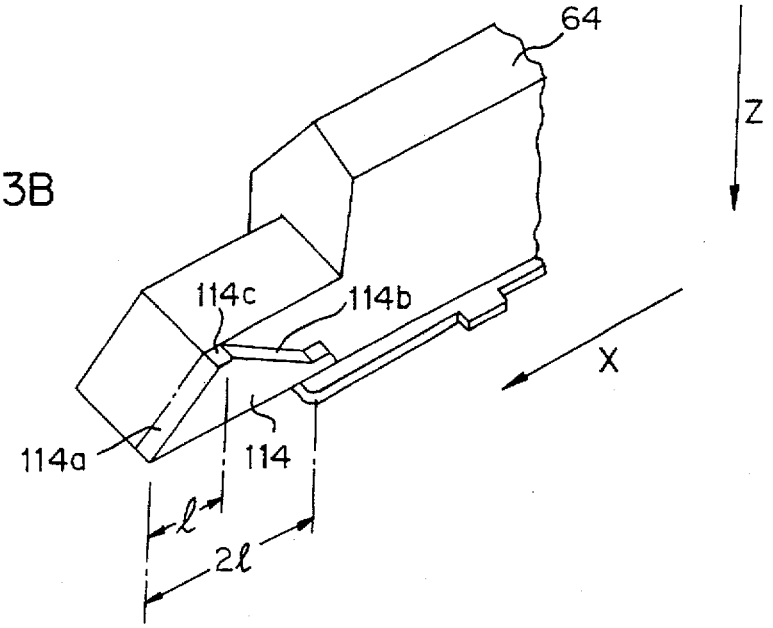
FIGS. 13A and 13B are perspective views showing the structure of the shutter member and the guide rib on the process cartridge according to a second embodiment of the present invention.
Figure 13A:
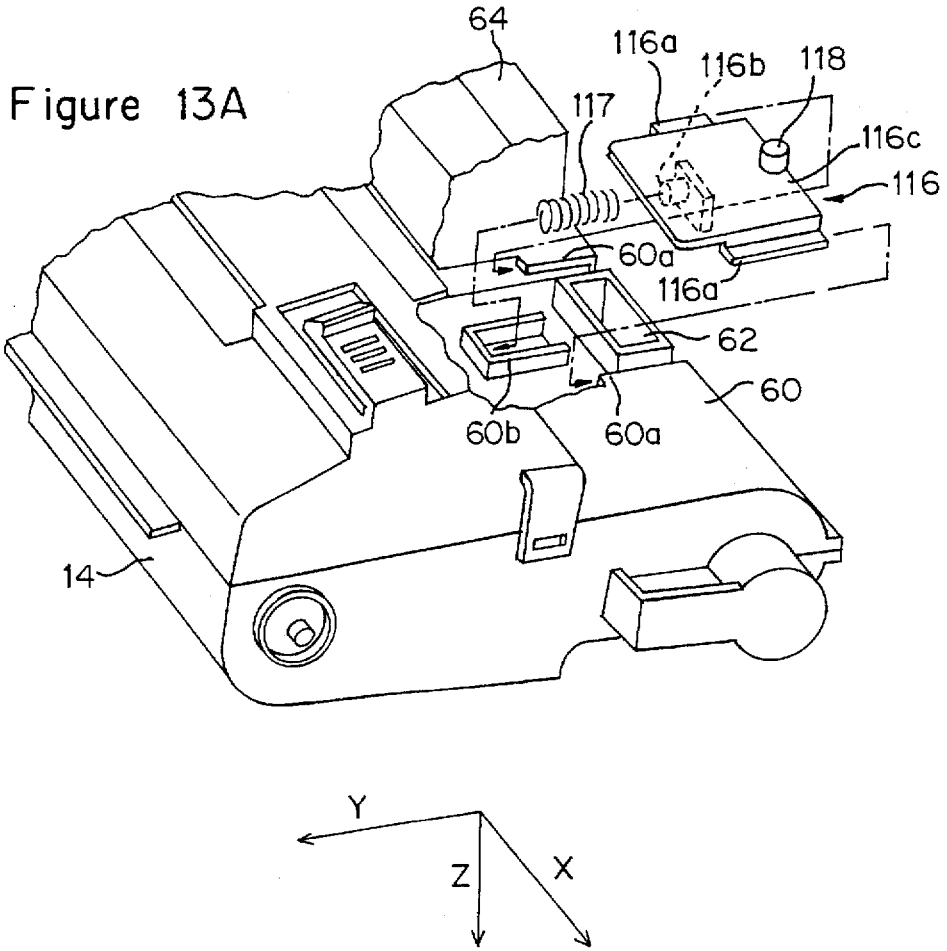

FIGS. 13A and 13B are perspective views of the process cartridge 14 according to a second embodiment of the present invention. According to the second embodiment, the first guide rib 114 formed on the process cartridge 14 is positioned at, e.g., a right angle relative to the second guide rib formed on the toner supply device in order to provide a more compact arrangement for the overall image forming apparatus.

As shown in FIG. 13A, the process cartridge 14 includes an upper cartridge 60 having a guide member 60*a*, a spring housing 60*b*, and a toner acceptance port 62 to accept toner supplied from a toner supply device detachably mountable to the main frame of the image forming apparatus. A shutter mechanism 116 is positioned to cover the toner acceptance port 62 when the process cartridge 14 is removed from the main frame of the image forming apparatus. Thus, when the toner supply and processing assembly are separated, for example by removal of either the process cartridge 14 or the toner supply device shown in FIG. 14, the shutter mechanism 116 closes the toner acceptance port 62 in order to close the toner flow path to the process cartridge.

The shutter mechanism 116 includes guide members 116*a* that engage with the guide members 60*a* to guide movement of the shutter mechanism 116 along an axis Y that is perpendicular to the direction of movement X of the process cartridge 14 during assembly or removal from the image forming apparatus. The shutter mechanism 116 also includes a spring engaging portion 116*b* positioned on the underside of the shutter mechanism 116 for engaging a spring 117. The spring 117, positioned within the spring housing 60*b*, exerts a biasing force on the spring engaging portion 116*b* that closes the shutter mechanism 116 over the toner acceptance port 62 when the shutter mechanism 116 is not engaged with a guide rib on the toner supply device. The shutter mechanism 116 also includes an engagement member 118 extending from the shutter member 116*c* of the shutter mechanism 116. As discussed below, the engagement member 118, upon engagement with the guide rib of the toner supply device, opens the shutter mechanism 116 to expose the toner acceptance port 62 that defines the toner flow path to the process cartridge 14.

FIG. 13B is another view of a part of the process cartridge 14 and provides a perspective view of the process cartridge guide rib 114. The process cartridge guide rib 114 is formed from an upper cartridge portion 64 positioned above the upper cartridge 60. The upper cartridge portion 64 and the process cartridge guide rib 114 are positioned above the shutter mechanism 116 as shown in FIGS. 16B, 17B, 18B and 19B in order to provide a compact arrangement. The process cartridge guide rib 114 includes inclined surfaces 114*a* and 114*b* preferably symmetrically disposed between a planar surface 114*c*. As discussed below, the process cartridge guide rib 114 engages the shutter mechanism on the toner supply device to selectively open and close the toner flow path as the process cartridge and the toner supply device are moved in relation to each other during assembly or disassembly of them to or from the image forming apparatus or with respect to each other.

Figure 14:
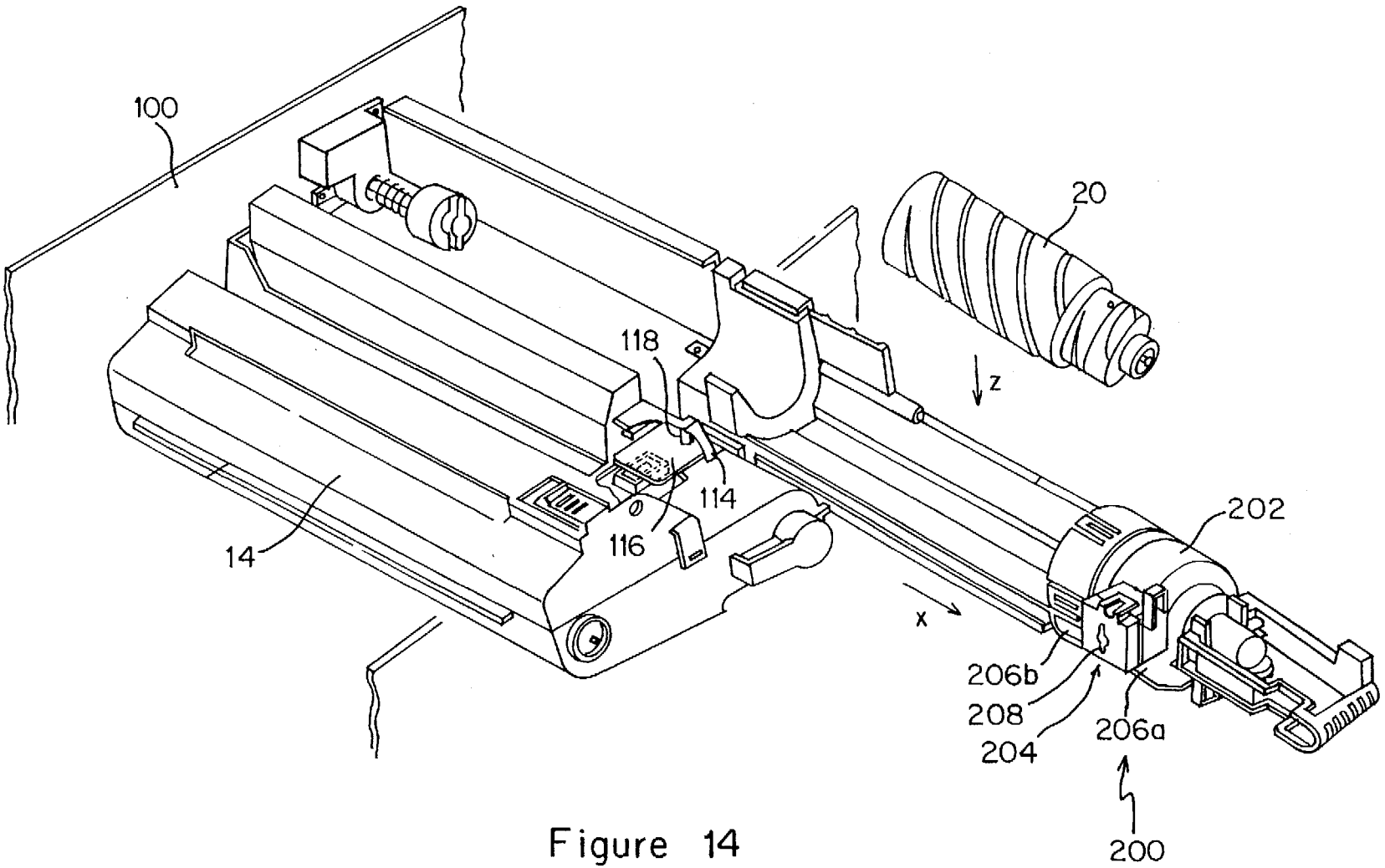
FIG. 14 is a partial exploded perspective view of the toner supply device and the process cartridge according to the second embodiment.

FIG. 14 is a partial exploded perspective view of the process cartridge 14 and a toner supply device 200 according to the second embodiment of the present invention. As shown in FIG. 14, the toner supply device 200 includes a toner hopper 202, a shutter mechanism 204, and a toner supply device guide rib 206 including a first rib portion 206*a* and a second rib portion 206*b*. The shutter mechanism 204 is integrated into the guide rib 206 and includes a cover 208 having an aperture to accommodate a projecting member of the shutter mechanism 204. The shutter mechanism 204 controls the toner flow path from the toner supply device 200. As shown in FIG. 14 and FIGS. 16A, 17A, 18A, and 19A, the shutter mechanism 204 is positioned within the toner supply device guide rib 206 to provide a more compact arrangement. As discussed below, the process cartridge guide rib 114 engages the shutter mechanism 204 to open a toner flow path from the toner supply device 200.

Figure 15A:
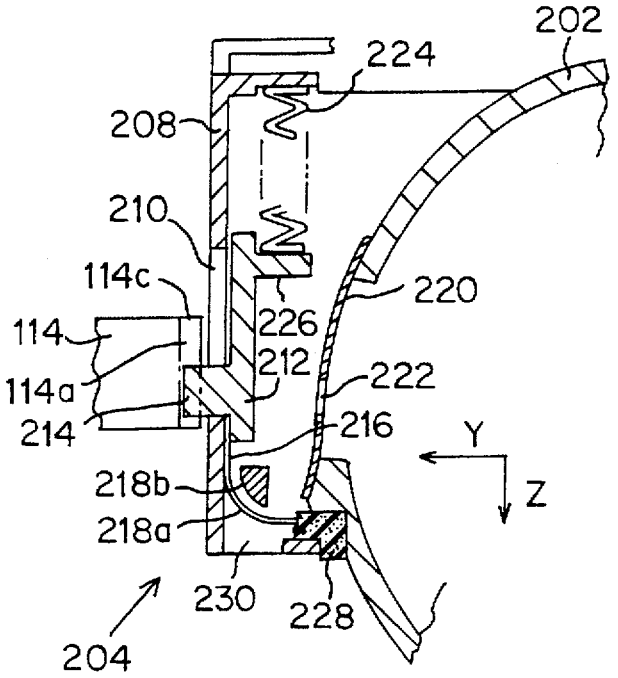
FIGS. 15A and 15B are cross-sectional views of the shutter assembly of the toner supply device of FIG. 14 in a closed and open state, respectively.
Figure 15B:
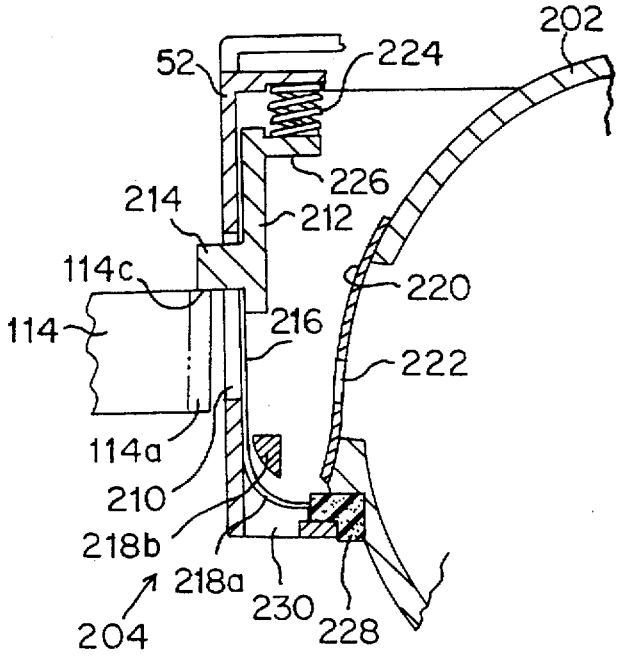

FIGS. 15A and 15B are cross sectional views of the shutter mechanism 204 in disengaged and engaged positions with the process cartridge guide rib 114, respectively. The shutter mechanism 204 comprises a cover 208 having an aperture 210, a shutter support member 212, a projecting member 214 formed on the shutter support member 212, a flexible shutter member 216 supported by the shutter support member 212, and a curvilinear guide member 218 comprising guide portions 218*a* and 218*b*. The shutter mechanism 204 receives toner from the hopper 202 through an elastic cover member 220 having an opening 222.

The shutter mechanism 204 further comprises a spring 224 that exerts a biasing force on an engagement portion 226 of the shutter support member 212 in a direction Z perpendicular to the movement direction X of the toner supply device 200 and the movement direction Y of the shutter mechanism 116 of the process cartridge. As shown in FIG. 15A, the biasing force on the shutter support member 212 maintains the flexible shutter member 216 in a closed position when the projecting member 214 of the shutter support member 212 is not engaged by the guide rib 114. The shutter mechanism 204 also includes a flexible sponge seal 228 at the end of the arcuate movement path formed by the curvilinear guide member 218 that forms a secure seal upon engagement with the flexible shutter member 216. Thus, the flexible seal 228 minimizes leakage of toner when the shutter mechanism 204 is in a closed position.

As shown in FIG. 15B, the engagement of the projecting member 214 of the shutter support member 212 with the guide rib 114 causes the shutter support member to move along the Z direction until the projecting member 214 reaches the planar surface 114*c*. The flexible shutter member 216 disengages from the flexible seal 228 and begins moving in the Y direction along the curvilinear guide member 218, until a point at which the flexible shutter member 216 is disengaged from the guide portions 218*a* and 218*b* of the curvilinear guide member 218. At this point, the flexible shutter member opens a toner supply port 230, enabling toner to flow through the opening 222 of the elastic cover member 220 and through the toner supply port 230. Thus, the toner supply port 230 defines a toner flow path from the toner supply device 200.

When the toner supply device 200 is separated from the process cartridge 14, the projecting member 214 is disengaged from the guide rib 114, and the biasing force of the spring 224 causes the shutter support member 212 to move along the Z direction to close the toner supply port 230. Specifically, the movement of the shutter support member 212 causes the flexible shutter member 218 to engage the curvilinear guide member 218 between the guide portions 218*a* and 218*b*. The guide portions 218*a* and 218*b* bend the flexible shutter member 216 as the shutter support member 212 moves the flexible shutter member 216 along the arcuate path formed by the curvilinear guide member 218. The toner supply port 230 is completely closed when the flexible shutter member 216 engages the flexible seal 228.

The operation of the shutter mechanisms 116 and 204 of the second embodiment will now be described with reference to FIGS. 16–19.

Figure 16A:
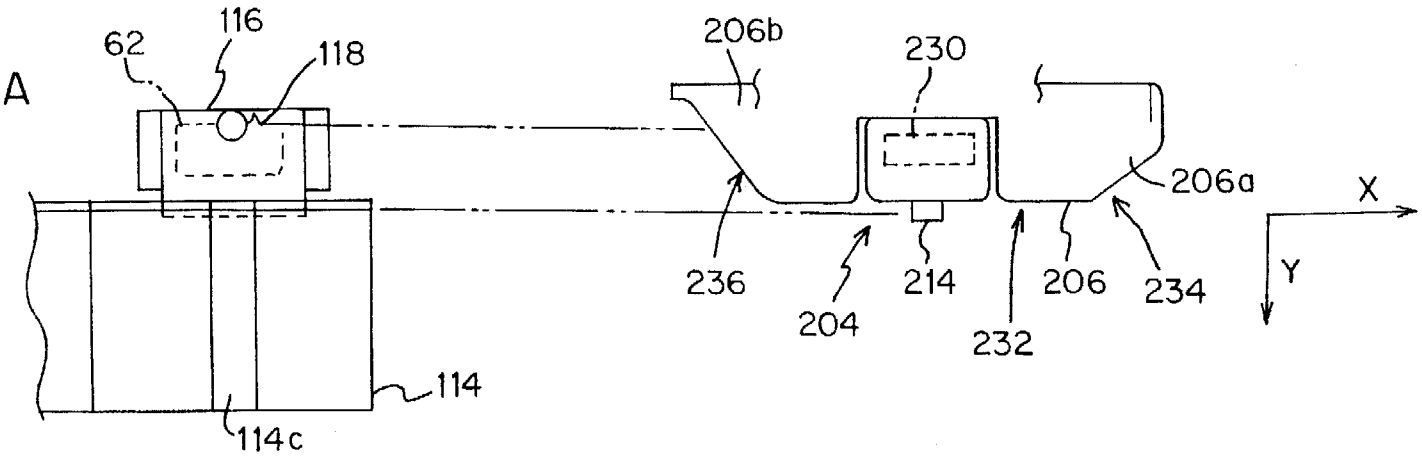
FIGS. 16A and 16B are top and side views, respectively, of the shutter assemblies of the process cartridge and the toner supply device of FIG. 14 in a disengaged position.
Figure 16B:
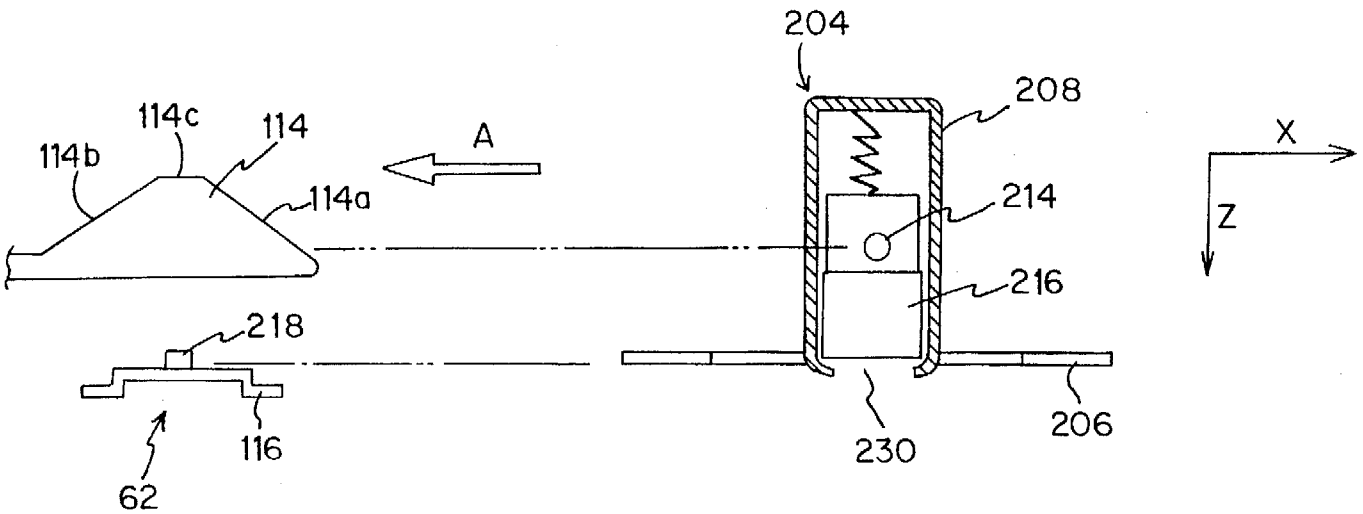
Figure 19A:
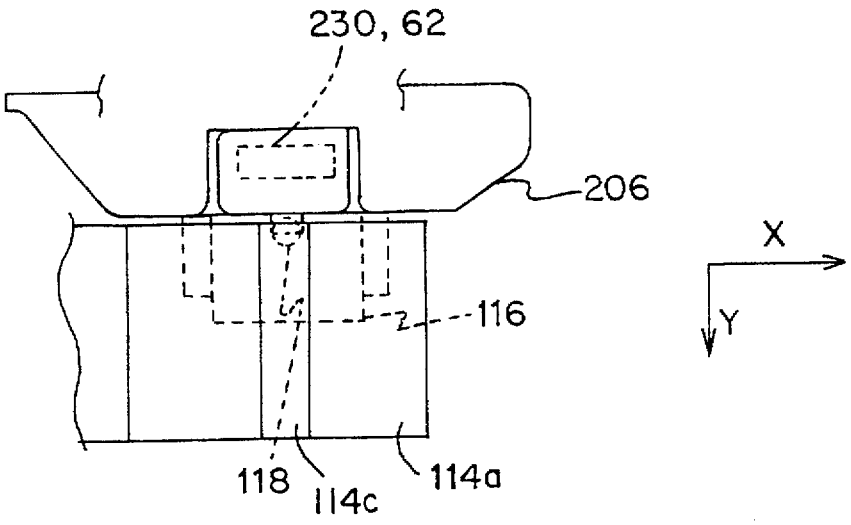
FIGS. 19A and 19B are top and side views showing the shutters of the process cartridge and the toner supply device in a fully opened position.
Figure 19B:
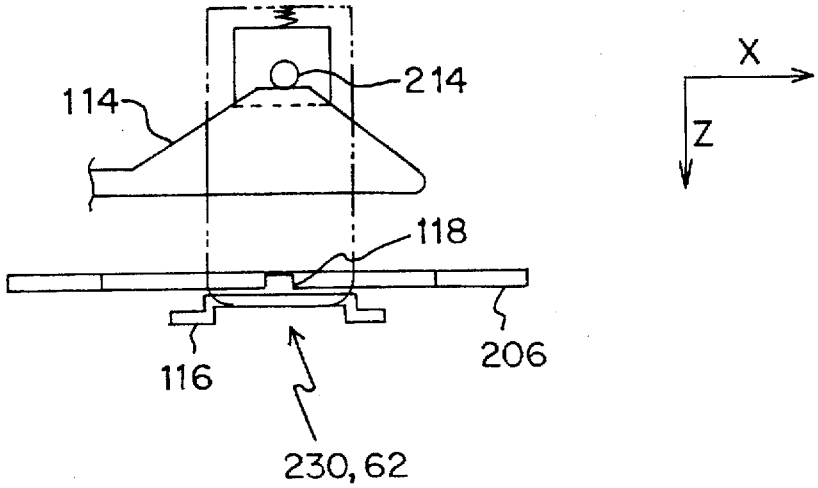

FIG. 16A is a top view of the shutter mechanism 116 and the guide rib 114 of the process cartridge 14 and the shutter mechanism 204 and the guide rib 206 of the toner supply device 200 in disengaged positions. FIG. 16B is a side view of the shutter mechanism 116, the guide rib 114, and the shutter mechanism 204. The guide rib 114 is positioned above the shutter mechanism 116, relative to the Z axis, to enable a more compact arrangement when the process cartridge 14 and the toner supply device 200 are engaged such that the toner acceptance port 62 and the toner supply port 230 are in substantial alignment, as shown in FIGS. 19A and 19B.

As shown in FIG. 16A, the toner supply device guide rib 206 includes a planar surface and inclined surfaces 234 and 236 preferably symmetrically positioned about the planar surface 232. Similar to the first embodiment, the overall length of the toner supply guide rib 206 is greater than the process cartridge 114 to ensure that the shutter mechanism 116 is engaged to open the toner acceptance port 62 before the shutter mechanism 204 is engaged to open the toner supply port 230.

Figure 17A:
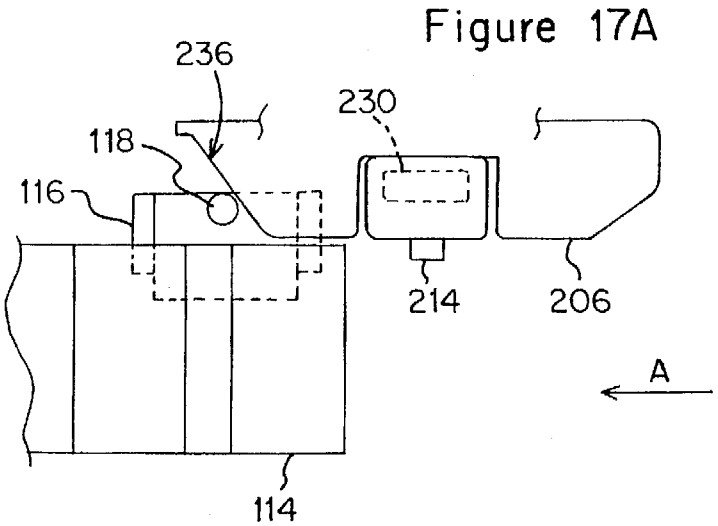
FIGS. 17A and 17B are top and side views, respectively, of the shutter of the process cartridge in an engaged position and the shutter of the toner supply device of FIG. 14 in a disengaged position.
Figure 17B:
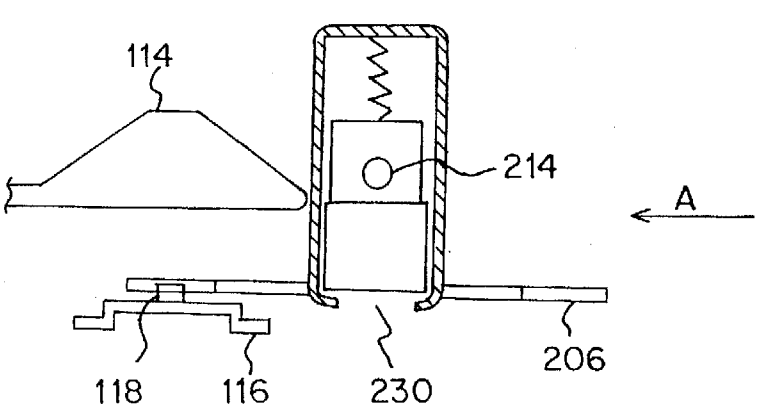

Referring to FIGS. 17A and 17B, as the toner supply device 200 is moved along axis X in direction A relative to the process cartridge 14, the engagement member 118 of the shutter mechanism 116 engages the inclined surface 236 of the toner supply device guide rib 206, causing the shutter mechanism 116 to begin moving in the Y direction. Thus, the shutter mechanism 116 of the process cartridge 14 is engaged with the guide engaging member 206 to open the toner acceptance port 62 before the shutter mechanism 204 is engaged with the guide rib 114. The rate at which the shutter mechanism 116 is opened is determined by the slope of the inclined surface 236. However, it is desirable that the shutter mechanism 116 is moved to substantially open the toner acceptance port 62 before the shutter mechanism 204 is engaged by the process cartridge guide rib 114.

Figure 18A:
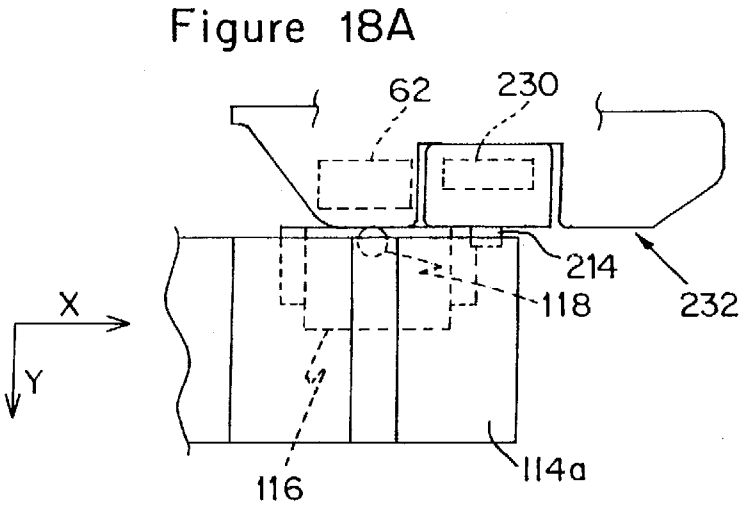
FIGS. 18A and 18B are top and side views showing the shutters of the process cartridge and the toner supply device in engaged positions to partially open the shutters.
Figure 18B:
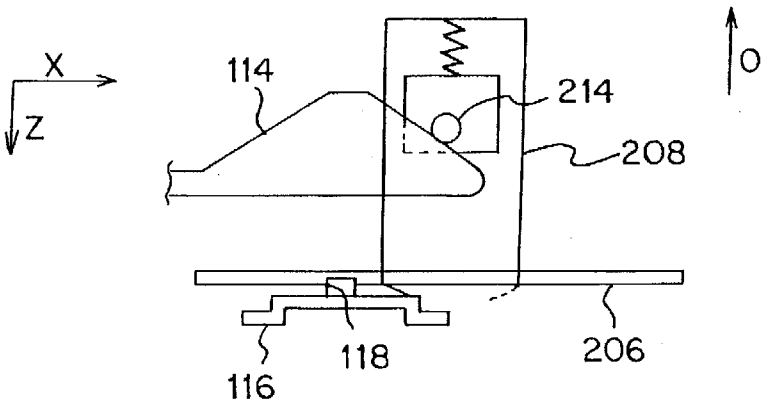

As shown in FIGS. 18A and 18B, the toner acceptance port 62 is substantially opened by engaging the engagement member 118 of the shutter mechanism 116 with the planar surface 232 of the toner supply device guide rib 206. The engagement member 118 is engaged with the planar surface 232 before the projecting member 214 of the shutter mechanism 204 engages the inclined surface 114*a* of the process cartridge guide rib 114. As the projecting member 214 engages the inclined surface 114*a*, the projecting member 214 moves the shutter support member 212 and the flexible shutter member 216 along the opening direction O along the Z axis to open the toner supply port 230.

As shown in FIGS. 19A and 19B, the projecting member 214 engages the planar surface 114*c* as the toner acceptance port 62 and the toner supply port 230 are substantially aligned along the X axis. Thus, the toner flow path between the process cartridge 14 and the toner supply device 200 is controlled such that the toner supply port 230 is not opened until the toner acceptance port 62 and the toner supply port 230 are in substantial alignment. In addition, the disengagement of the toner supply device 200 relative to the process cartridge 14 causes the shutter mechanism 204 to close the toner supply port 230 before the toner acceptance port 62 is closed. Thus, any residual toner during the closing of the toner supply port 230 will be collected by the toner acceptance port 62.

Thus, the second embodiment of the present invention provides a compact arrangement of the toner supply and processing assembly, while maintaining all of the advantages of the first embodiment. As recognized in the art, the rate at which the apertures are opened and closed is proportional to the elevation and length of the inclined surfaces of the guide ribs. Hence, the shutter mechanisms controlling the toner supply port can be opened and closed more quickly by providing a greater elevation relative to the length.

In accordance with present invention, the shutter members are opened and closed using guide ribs, as opposed to using electrical actuators. Since the shutter members are opened and closed in association with the detachment operation of the process cartridge or the toner supply device, electric components as seen in the prior art are not required so that toner leakage or dispersion can be prevented while attempting to reduce cost.

In accordance with the present invention, the shutter member at the toner supply port of the toner supply device is opened only at the time when both units of the toner supply device and the process cartridge are set in the main body of the image forming apparatus. When either the process cartridge or the toner supply device is removed from the main body of the image forming apparatus, the shutter member at the toner supply port is closed so that toner dispersion into the image forming apparatus from the toner supply port or out of the main body of the image forming apparatus can be prevented.

In accordance with the present invention, even when the process cartridge or the toner supply device is individually removed from the main body of the image forming apparatus, each projecting part is guided with a guide rib having substantially symmetrically disposed inclined surfaces so that each shutter member is opened and closed individually during attachment and removal from the image forming apparatus. Consequently, at the time of attachment and removal of the process cartridge or the toner supply device, the shutter member is smoothly opened and closed.

In accordance with the present invention, since the shutter member provided on the case of the process cartridge is opened before the shutter member provided on the case of the toner supply device and the shutter member provided on the case of the process cartridge is closed after than the shutter member provided on the case of the toner supply device, toner dispersion in the main body of the image forming apparatus can be prevented.

While this invention has been described in connection with what are presently considered to be the most practical embodiments, it is to be understood that the invention is not limited to the disclosed embodiments, but, on the contrary, is intended to cover various modifications and equivalent arrangements included within the spirit and scope of the appended claims.

What is claimed is:

1. A toner supply assembly detachably mountable to an image forming apparatus having a processing assembly, the toner supply assembly comprising:

a toner supply port providing a toner flow path to and from said assembly;

a first movable shutter controlling said toner flow path; and a projecting member extending from the first shutter and adapted for moving said first shutter in response to engagement with a first engaging member formed on said processing assembly as the toner supply assembly and said processing assembly are brought together to open the toner flow path, said first shutter closing the toner flow path in response to disengagement of said projecting member with the first engaging member as said toner supply assembly and processing assembly are separated.

2. A toner supply assembly detachably mountable to an image forming apparatus having a processing assembly, the toner supply assembly comprising:

a toner supply port providing a toner flow path to and from said assembly;

a first movable shutter controlling said toner flow path;

a projecting member extending from the first shutter and adapted for moving said first shutter in response to engagement with a first engaging member formed on said processing assembly as the toner supply assembly and said processing assembly are brought together to open the toner flow path, said first shutter closing the toner flow path in response to disengagement of said projecting member with the first engaging member as said toner supply assembly and processing assembly are separated; and a biasing device exerting a biasing force on the first shutter to close the toner flow path upon said disengagement of said projecting member.

3. An assembly as in claim 2, wherein said first shutter comprises:

a shutter member movable relative to said toner flow path to open or close said toner flow path;

a guide establishing a movement path for said shutter member; and a shutter supporting member coupled to said projecting member and said biasing device and moving said shutter member along the movement path in response to said engagement and disengagement of said projecting member.

4. An assembly as in claim 3, wherein said shutter member is flexible and said guide provides an arcuate path as said movement path.

5. An assembly as in claim 4, wherein said guide bends said shutter member along the arcuate movement path as said shutter supporting member moves said shutter member.

6. An assembly as in claim 5, wherein said biasing device exerts said biasing force in a linear direction.

7. An assembly as in claim 4, wherein said guide defines an axis of said arcuate path and said shutter member is rotatable about said axis.

8. An assembly as in claim 4, wherein said biasing device exerts said biasing force about said axis.

9. An assembly as in claim 1, wherein said first shutter comprises:

a shutter member movable relative to said toner flow path to open or close said toner flow path;

a guide establishing a movement path for said shutter member; and a shutter supporting member coupled to said projecting member and moving said shutter member along the movement path in response to said engagement and disengagement of said projecting member.

10. An assembly as in claim 9, wherein said shutter member is flexible and said guide provides an arcuate path as said movement path.

11. An assembly as in claim 10, wherein said guide bends said shutter member along the arcuate movement path as said shutter supporting member moves said shutter member, the first shutter further comprising a flexible seal at an end of said arcuate movement path, said shutter member engaging said flexible seal to close said toner flow path.

12. A toner supply assembly detachably mountable to an image forming apparatus having a processing assembly, the toner supply assembly comprising:

a toner supply port providing a toner flow path to and from said assembly;

a first movable shutter controlling said toner flow path; and a projecting member extending from the first shutter and adapted for moving said first shutter in response to engagement with a first engaging member formed on said processing assembly as the toner supply assembly and said processing assembly are brought together to open the toner flow path, said first shutter closing the toner flow path in response to disengagement of said projecting member with the first engaging member as said toner supply assembly and processing assembly are separated;

wherein said first shutter comprises:

a shutter member movable relative to said toner flow path to open or close said toner flow path;

a guide establishing a movement path for said shutter member; and a shutter supporting member coupled to said projecting member and moving said shutter member along the movement path in response to said engagement and disengagement of said projecting member;

wherein said guide defines an axis of said arcuate path and said shutter member is rotatable about said axis.

13. A toner supply assembly detachably mountable to an image forming apparatus having a processing assembly, the toner supply assembly comprising:

a toner supply port providing a toner flow path to and from said assembly;

a first movable shutter controlling said toner flow path;

a projecting member extending from the first shutter and adapted for moving said first shutter in response to engagement with a first engaging member formed on said processing assembly as the toner supply assembly and said processing assembly are brought together to open the toner flow path, said first shutter closing the toner flow path in response to disengagement of said projecting member with the first engaging member as said toner supply assembly and processing assembly are separated; and further comprising a second engaging member for engaging and opening a second movable shutter disposed on the processing assembly and controlling said toner flow path between said first shutter and said processing assembly, said second engaging member positioned to engage said second movable shutter before the engagement between the first movable shutter and the first engaging member.

14. A toner supply and processing assembly for an image forming apparatus, comprising:

a process cartridge for image development, detachably mountable to a main frame of the image forming apparatus;

a toner supply device, detachably mountable to the main frame of the image forming apparatus, for supplying toner to said process cartridge;

a shutter mechanism including a first movable shutter member for controlling a toner flow path between said toner supply device and said process cartridge;

a first engagement member extending from said first shutter member; and a second engagement member outside said first shutter member and positioned to contact said first engagement member such that as the cartridge and toner supply device are moved in relation to each other during assembly thereof to or disassembly thereof from said image forming apparatus, the first shutter member moves to open or close the toner flow path.

15. A toner supply and processing assembly for an image forming apparatus, comprising:

a process cartridge for image development, detachably mountable to a main frame of the image forming apparatus;

a toner supply device, detachably mountable to the main frame of the image forming apparatus, for supplying toner to said process cartridge;

a shutter mechanism including a first movable shutter member for controlling a toner flow path between said toner supply device and said process cartridge;

a first engagement member extending from said first shutter member; and a second engagement member outside said first shutter member and positioned to contact said first engagement member such that as the cartridge and toner supply device are moved in relation to each other during assembly thereof to or disassembly thereof from said image forming apparatus, the first shutter member moves to open or close the toner flow path, wherein said shutter mechanism further comprises:

a guide member moving said first shutter member along an arcuate path; and a biasing device exerting a biasing force on said first shutter member in a direction opposing said second engagement member.

16. An assembly as in claim 15, wherein the direction of said biasing force causes said first shutter member to engage said guide member along said arcuate path, said guide member bending said first shutter member along said arcuate path.

17. An assembly as in claim 16, wherein said shutter mechanism further comprises a flexible seal at an end of said arcuate path, said first shutter member engaging said flexible seal to close said toner flow path.

18. An assembly as in claim 15, wherein said guide member defines an axis of said arcuate path and said first shutter member is rotatable about said axis.

19. A toner supply and processing assembly for an image forming apparatus, comprising:

a process cartridge for image development, detachably mountable to a main frame of the image forming apparatus;

a toner supply device, detachably mountable to the main frame of the image forming apparatus, for supplying toner to said process cartridge;

a shutter mechanism including a first movable shutter member for controlling a toner flow path between said toner supply device and said process cartridge;

a first engagement member extending from said first shutter member; and a second engagement member outside said first shutter member and positioned to contact said first engagement member such that as the cartridge and toner supply device are moved in relation to each other during assembly thereof to or disassembly thereof from said image forming apparatus, the first shutter member moves to open or close the toner flow path, wherein:

said second engagement member comprises a planar surface, and first and second inclined surfaces substantially symmetrically extending from each end of the planar surface; and said first engagement member, in response to engagement with one of the first and second inclined surfaces, moves the first shutter member to open the toner flow path, to a maximum open position upon engagement of said first engagement member with the planar surface.

20. A toner supply and processing assembly for an image forming apparatus, comprising:

a process cartridge for image development, detachably mountable to a main frame of the image forming apparatus;

a toner supply device, detachably mountable to the main frame of the image forming apparatus, for supplying toner to said process cartridge;

a shutter mechanism including a first movable shutter member for controlling a toner flow path between said toner supply device and said process cartridge;

a first engagement member extending from said first shutter member; and a second engagement member outside said first shutter member and positioned to contact said first engagement member such that as the cartridge and toner supply device are moved in relation to each other during assembly thereof to or disassembly thereof from said image forming apparatus, the first shutter member moves to open or close the toner flow path, wherein said shutter mechanism is formed on said toner supply device and said second engagement member is formed on said process cartridge.

21. An assembly as in claim 20, further comprising:

a second movable shutter member formed on said process cartridge and controlling the toner flow path between said shutter mechanism on the toner supply device and said process cartridge;

a third engagement member extending from said second shutter member;

a fourth engagement member formed on said toner supply device and positioned to engage said third engagement member such that the second shutter member moves to open or close the toner flow path as the cartridge and toner supply device are moved in relation to each other.

22. An assembly as in claim 21, wherein said first and third engagement members are moved in directions perpendicular to a first direction of movement of said cartridge relative to said toner supply device.

23. An assembly as in claim 22, wherein said first and third engagement members are moved in second and third directions, respectively, said first, second, and third directions being mutually perpendicular.

24. An assembly as in claim 23, wherein:

said second and fourth engagement members are each axially disposed along said first direction;

said second engagement member has an inclined surface extending in said second direction with respect to said first direction; and said third engagement member has an inclined surface extending in said third direction with respect to said first direction.

25. An assembly as in claim 24, wherein said second and fourth engagement members each further include planar surfaces with respect to said second and third directions, respectively, said planar surfaces of said second and fourth engagement members positioned to open said toner flow path as said first and second shutters are aligned, respectively.

26. An assembly as in claim 25, wherein the shutter mechanism is positioned within the fourth engagement member.

27. An assembly as in claim 26, wherein said second and fourth engagement members are positioned such that the fourth engagement member engages the third engagement member to begin opening the second shutter member before the second engagement member engages the first engagement member.

28. An assembly as in claim 27, wherein said second and fourth engagement members are positioned such that the second engagement member disengages the first engagement member before the fourth engagement member disengages the third engagement member.

29. An assembly as in claim 22, wherein said second and third directions are mutually parallel.

30. A toner supply and processing assembly for an image forming apparatus, comprising:

a process cartridge detachably mountable to a main frame of the image forming apparatus along a first axis, the process cartridge comprising:

(1) a first guide rib having a first surface lying on said first axis and a second surface extending from said first surface at a first acute angle thereto;

(2) a first shutter movable along a second axis perpendicular to the first axis and controlling a first toner flow path to the process cartridge; and a toner supply device, detachably mountable to the main frame of the image forming apparatus along said first axis, for supplying toner to said process cartridge and comprising:

(1) a second guide rib having a third surface lying on said said first axis and a fourth surface extending from said third surface at a second acute angle thereto, wherein said first shutter opens said first toner flow path in response to engagement thereof with said second guide rib, and (2) a second shutter comprising a shutter support member movable along a third axis perpendicular to the first and second axes and a flexible shutter member supported by the shutter support member and controlling a second toner flow path from the toner supply device, the shutter support member, in response to engagement thereof with said first guide rib, moving the flexible shutter member and opening said second toner flow path;

wherein said first and second guide ribs are positioned to open or close the first and second toner flow paths as the process cartridge and the toner supply device are moved in relation to each other during assembly thereof to or disassembly thereof from said image forming apparatus.

31. An assembly as in claim 30, wherein the second shutter further comprises a biasing device exerting a biasing force along said third axis on said shutter support member and opposing said first guide rib.

32. An assembly as in claim 31, wherein second shutter comprises a curvilinear guide member for translating movement of said flexible shutter member between said second and third axes, said biasing force causing said shutter support member, upon disengagement thereof with said first guide rib, to move the flexible shutter member along the curvilinear guide member to close the second toner flow path.

33. An assembly as in claim 32, wherein said second shutter further comprises a flexible seal at an end of said curvilinear guide member, said flexible shutter member engaging said flexible seal to close the second toner flow path.

34. An assembly as in claim 30, wherein:

said first guide rib further comprises a fifth surface extending from said first surface and substantially symmetrically positioned with respect to said second surface;

said second guide rib further comprises a sixth surface extending from said third surface and substantially symmetrically positioned with respect to said fourth surface; and the first and second shutters move to fully open positions in response to engagement thereof with the third and first surfaces, respectively.

35. An assembly as in claim 34, wherein said first and second guide ribs are positioned such that the second guide rib engages the first shutter before the first guide rib opens the second shutter.

36. An assembly as in claim 35, wherein said first and second guide ribs are positioned such that the second guide rib disengages the first shutter before the first guide rib disengages the second shutter.

37. A toner supply and processing assembly for an image forming apparatus, comprising:

a process cartridge detachably mountable to a main frame of the image forming apparatus along a first axis, the process cartridge comprising:

(1) a first guide rib having a first surface lying on said first axis and a second surface extending from said first surface and forming a first acute angle thereto;

(2) a first shutter movable along a second axis perpendicular to the first axis and controlling a first toner flow path to the process cartridge; and a toner supply device, detachably mountable to the image forming apparatus along said first axis, for supplying toner to said process cartridge and comprising:

(1) a second guide rib having a third surface lying on said first axis and a fourth surface extending from said third surface and forming a second acute angle thereto, wherein said first shutter opens said first toner flow path in response to engagement thereof with said second guide rib, and (2) a second shutter comprising a shutter member movable along said second axis and controlling a second toner flow path from the toner supply device, the shutter member, in response to engagement thereof with said first guide rib, opening said second toner flow path;

wherein said first and second guide ribs are positioned to open or close the first and second toner flow paths as the process cartridge and the toner supply device are moved in relation to each other during assembly thereof to or disassembly thereof from said image forming apparatus.

38. An assembly as in claim 37, wherein the second shutter further comprises a biasing device exerting a biasing force on said shutter member and opposing said first guide rib.

39. An assembly as in claim 38, wherein said biasing force causes said shutter member, upon disengagement with said first guide rib, to close the second toner flow path.

40. An assembly as in claim 37, wherein said first guide rib further comprises a fifth surface extending from said first surface and substantially symmetrically positioned with respect to said second surface;

said second guide rib further comprises a sixth surface extending from said third surface and substantially symmetrically positioned with respect to said fourth surface; and the first and second shutters move to full open positions in response to engagement thereof with the third and first surfaces, respectively.

41. An assembly as in claim 40, wherein said first and second guide ribs are positioned such that the second guide rib engages the first shutter before the first guide rib opens the second shutter.

42. An assembly as in claim 41, wherein said first and second guide ribs are positioned such that the second guide rib disengages the first shutter before the first guide rib disengages the second shutter.

43. A toner supply and processing assembly for an image forming apparatus, comprising:

a process cartridge, detachably mountable to a main frame of the image forming apparatus along a first axis, comprising an engagement member positioned thereon; and a toner supply device detachably mountable to the main frame of the image forming apparatus along said first axis and comprising:

(1) a shutter support member movable along a second axis perpendicular to said first axis, and (2) a flexible shutter member supported by the shutter support member for controlling a toner flow path along said second axis and between said toner supply device and said process cartridge, said flexible shutter member adapted for bending to move in a direction perpendicular to said second axis to close the toner flow path in response to disengagement of said shutter support member with said engagement member as said toner supply device and said process cartridge are separated.

44. An assembly as in claim 43, wherein said toner supply device further comprises a biasing device exerting a biasing force on the shutter support member to close the toner flow path upon said disengagement of said shutter support member.

45. An assembly as in claim 44, wherein said toner supply device further comprises a guide member adapted for bending said flexible shutter to translate movement thereof between said second axis and said direction perpendicular to said second axis.

46. An assembly as in claim 45, wherein said toner supply device further comprises a flexible seal positioned to seal said toner control path by engaging with said flexible shutter during movement thereof along said direction perpendicular to said second axis.

47. An assembly as in claim 43, wherein:

said process cartridge further comprises a movable shutter controlling the toner flow path between said flexible shutter member of the toner supply device and said process cartridge; and said toner supply device further comprises a second engagement member positioned to engage said movable shutter of said process cartridge such that the movable shutter moves to open or close the toner flow path as the process cartridge and the toner supply device are moved in relation to each other.

48. An assembly as in claim 47, wherein said engagement member of said process cartridge and said second engagement member are positioned such that the engagement member disengages the shutter support member before the second engagement member disengages the movable shutter of the process cartridge.

49. An image forming apparatus, comprising:

a process cartridge for image development, detachably mountable to a main frame of the image forming apparatus; and a toner supply device, for supplying toner to said process cartridge, detachably mountable to the main frame of the image forming apparatus; wherein the process cartridge and the toner supply device are each separately and independently detachably mountable to the main frame.

50. A toner supply assembly detachably mountable to an image forming apparatus having a processing assembly, the toner supply assembly comprising:

a toner supply port providing a toner flow path to and from said assembly;

a first movable shutter controlling said toner flow path; and a projecting member extending from the first shutter and adapted for moving said first shutter in response to engagement with a first engaging member formed on said processing assembly as the toner supply assembly and said processing assembly are brought together to open the toner flow path, said first shutter closing the toner flow path in response to disengagement of said projecting member with the first engaging member as said toner supply assembly and processing assembly are separated, wherein the first engaging member comprises a first guide rib, arcuate in shape, and a projecting member slidable on the first arcuate guide rib for opening and closing the toner flow path.

* * * * *